US006793324B2

(12) United States Patent
Hosono et al.

(10) Patent No.: US 6,793,324 B2
(45) Date of Patent: Sep. 21, 2004

(54) LIQUID JETTING HEAD AND LIQUID JETTING APPARATUS INCORPORATING THE SAME

(75) Inventors: Satoru Hosono, Nagano (JP); Hirofumi Teramae, Nagano (JP); Tomoaki Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/378,084

(22) Filed: Mar. 4, 2003

(65) Prior Publication Data

US 2003/0234826 A1 Dec. 25, 2003

(30) Foreign Application Priority Data

Mar. 4, 2002 (JP) ..... P2002-058045
Aug. 23, 2002 (JP) ..... P2002-243994

(51) Int. Cl.[7] ..... B41J 2/04
(52) U.S. Cl. ..... 347/54
(58) Field of Search ..... 347/54, 68, 69, 347/70, 71, 50, 40, 20, 44, 47, 27, 63; 399/261; 361/700; 310/328–330; 29/890.1

(56) References Cited

U.S. PATENT DOCUMENTS 6,058,761 A * 5/2000 Vander Heyden ..... 73/32 R

FOREIGN PATENT DOCUMENTS

| | | |
|---|---|---|
| JP | 10-278360 | 10/1998 |
| JP | 2000-263818 | 9/2000 |
| JP | 2002-29042 | 1/2002 |

* cited by examiner

*Primary Examiner*—Raquel Yvette Gordon
(74) *Attorney, Agent, or Firm*—Sughrue Mion, PLLC

(57) ABSTRACT

A pressure generating element is associated with a pressure chamber communicated with a nozzle orifice. The pressure generating element is operable to generate pressure fluctuation in liquid contained in the pressure chamber to eject a liquid droplet from the nozzle orifice, when a drive signal is supplied thereto. An identifier is provided with ID information including a first deviation of an ejected liquid amount from a designed value when a drive signal at a first, regular drive frequency is supplied, and a second deviation of an ejected liquid amount from the designed value when a drive signal at a second, operable maximum drive frequency is supplied.

15 Claims, 12 Drawing Sheets

FIG. 9

| RECORDING MODE | COM1 | COM2 | COM3 |
|---|---|---|---|
| | LARGE | SMALL | SMALL |
| DRIVING FREQUENCY (fmax/2) | 17kHz | 17kHz | 17kHz |
| DETERMINED CONDITION (INK AMOUNT) | 40.0ng | 2.5ng | 1.6ng |
| APPROPRIATE VOLTAGE | VH1 | VH2S | VH4S |

FIG. 10A

| DRIVE WAVEFORM | COM2 |
|---|---|
| | SMALL |
| DRIVING FREQUENCY (fmax/2) | 17kHz |
| DRIVING VOLTAGE | VH2S |
| NUMBER OF DRIVEN NOZZLE (EACH ROW) | 90 |
| TEMPERATURE | 25°C |

FIG. 10B

| NOZZLE ROW | 1 | 2 | 3 | 4 | 5 | 6 |
|---|---|---|---|---|---|---|
| COLOR ID | 46 | 50 | 54 | 46 | 50 | 54 |

FIG. 10C

| NOZZLE ROW | 1 | 2 | 3 | 4 | 5 | 6 |
|---|---|---|---|---|---|---|
| COLOR ID | 46 | 42 | 50 | 58 | 50 | 46 |

FIG. 11A

| DRIVE WAVEFORM | COM2 |
|---|---|
| | SMALL |
| DRIVING FREQUENCY (fmax) | 34kHz |
| DRIVING VOLTAGE | VH2S |
| NUMBER OF DRIVEN NOZZLE (EACH ROW) | 90 |
| TEMPERATURE | 25°C |

FIG. 11B

| IwF | SETTING CONDITION |
|---|---|
| 0 | Iw/2.5 > 1.50 |
| 1 | 1.50 ≥ Iw/2.5 > 1.25 |
| 2 | 1.25 ≥ Iw/2.5 > 1.00 |
| 3 | 1.00 ≥ Iw/2.5 |

FIG. 11C

| NOZZLE ROW | 1 | 2 | 3 | 4 | 5 | 6 |
|---|---|---|---|---|---|---|
| FREQUENCY ID | 2 | 2 | 1 | 1 | 2 | 2 |

FIG. 11D

| NOZZLE ROW | 1 | 2 | 3 | 4 | 5 | 6 |
|---|---|---|---|---|---|---|
| FREQUENCY ID | 3 | 3 | 1 | 2 | 2 | 2 |

FIG. 13A
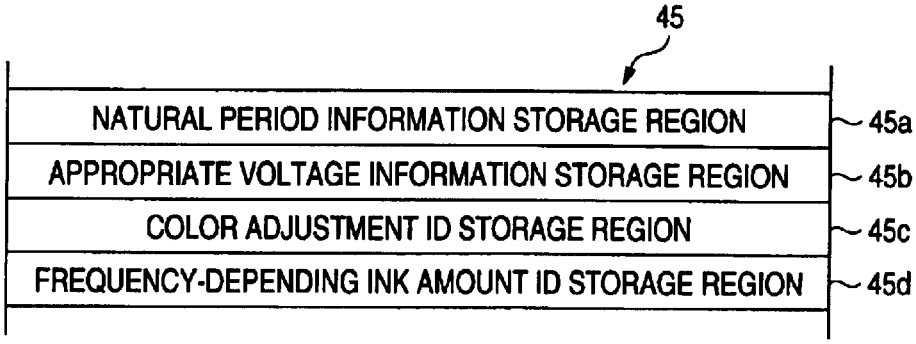
FIG. 13B
45e
| IwF | LIMIT FOR EJECTION AMOUNT |
|---|---|
| 0 | 66% |
| 1 | 73% |
| 2 | 88% |
| 3 | 100% |
FIG. 14
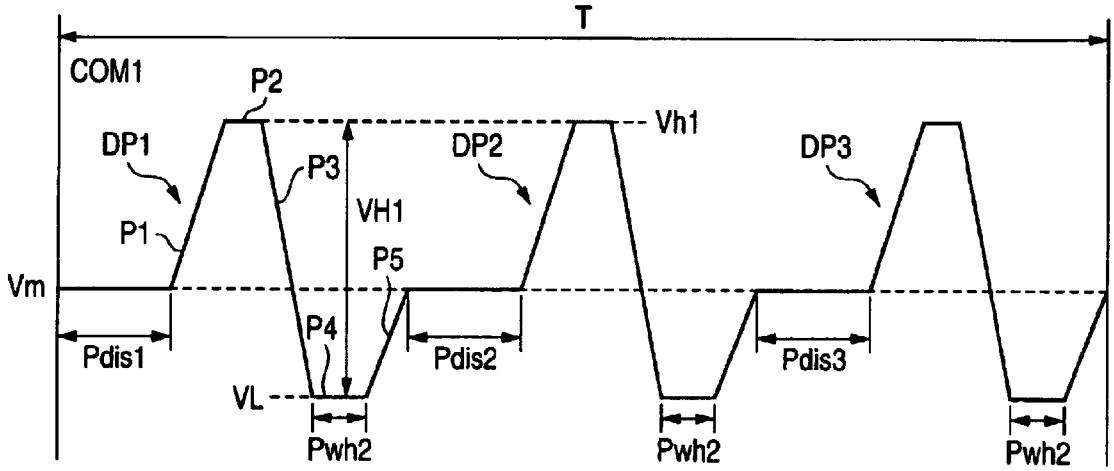

LIQUID JETTING HEAD AND LIQUID JETTING APPARATUS INCORPORATING THE SAME

BACKGROUND OF THE INVENTION

The present invention relates to a liquid ejecting head which ejects any of various types of liquids in the form of droplets, and to a liquid ejecting apparatus having the liquid ejecting head; for example, an image recording apparatus such as an ink jet printer, a display manufacturing apparatus for manufacturing a display or the like, an electrode formation apparatus which forms electrodes, and a chip manufacturing apparatus for manufacturing chips.

A liquid ejecting apparatus has an ejection head and ejects (discharges) any of various types of liquids from the ejection head. For example, the liquid ejecting apparatus is an image recording apparatus, such as an ink jet printer or an ink jet plotter. However, the liquid ejecting device has recently been applied to various pieces of manufacturing apparatus while the ability to accurately supply a nominal volume of liquid to a predetermined position is exploited. For instance, the liquid ejecting apparatus is applied to a display manufacturing apparatus for manufacturing a color filter of a liquid-crystal display, an electrode forming apparatus for forming electrodes for an organic Electro Luminescence (EL) display and an FED (Field Emission Display), and a chip manufacturing apparatus for manufacturing biochips (biochemical elements). A recording head for use with an image recording apparatus ejects fluid ink. A coloring material ejection head for use with a display manufacturing apparatus ejects solutions of R (red), G (green), and B (blue) coloring materials. An electrode material ejection head for use with an electrode forming apparatus ejects liquid electrode material. Liquid-shaped electrode material is ejected from an electrode material ejection head for use with an electrode forming apparatus, and a bio-organic substance ejection head for use with a chip manufacturing apparatus ejects a solution of bio-organic substance.

Accurate control of the volume of a droplet to be ejected is essential for the liquid ejecting apparatus of this type. Because of manufacturing circumstances, variations tend to arise in the volume of a droplet to be ejected on a per-ejection-head basis or for each row of nozzles. In order to prevent occurrence of variations in the volume of a droplet to be ejected, the volume of a droplet to be ejected is controlled by use of information about a deviation in the volume of a droplet to be ejected. For instance, in the case of the image recording apparatus, variations in the ink amount cause a designed standard volume to deviate from the ink amount impacted per unit area. The density of a recorded image also deviates from a standard density. Therefore, a deviation in the ink amount to be ejected is acquired for each recording head, and the ink amount impacted is controlled by use of identification information showing the deviation (described on, e.g., pp. 4 to 5 and in FIG. 4 in Japanese Patent Publication No. 10-278360A). As a result, the ink amount impacted per unit area is made uniform, thereby enabling recording with superior image quality.

Strong desire exists for a speedup in ejection of a droplet from the liquid ejecting apparatus of this type. For this reason, actuation of piezoelectric elements (e.g., piezoelectric vibrators) provided on the ejection head at higher speed is desired. For example, an attempt has been made to increase the maximum drive frequency of a drive pulse from 13 kHz to 35 kHz approximately.

However, when the drive frequency of the drive pulse has been increased so as to become higher than the conventional drive frequency, the volume of a droplet to be ejected is found to change according to the drive frequency of a drive pulse. For instance, when a single drive pulse is supplied to a pressure generating element while a drive frequency of the drive pulse is changed, the ink amount is found to increase as the drive frequency is increased in a frequency range higher than a conventionally-used frequency band. This is considered to result from the state of a meniscus. More specifically, since the time interval from ejection of a droplet until ejection of the next droplet has become shorter, the next droplet is ejected before vibration of the meniscus, which has arisen immediately after ejection of the droplet, sufficiently disappears. Hence, a difference in the state of the meniscus is considered to be responsible for occurrence of a difference in the volume of a droplet to be ejected (i.e., the volume of a droplet). Further, the rate of increase in the volume of a droplet in a high frequency range is also found to vary from one recording head to another.

For these reasons, even when the number of droplets ejected per unit time is corrected on the basis of the identification information, mere use of the technique described in Japanese Patent Publication No. 10-278360A cannot prevent occurrence of a variation in the volume of a droplet impacted per unit area, which would otherwise occur in accordance with an employed frequency.

SUMMARY OF THE INVENTION

The invention has been conceived in view of the circumstances and provides a liquid ejecting head and a liquid ejecting apparatus, which can prevent occurrence of variations in the volume of a droplet impacted even when the frequency of a drive pulse which can be supplied is increased.

In order to achieve the above object, according to the invention, there is provided a liquid jetting head, comprising:

- a pressure generating element, associated with a pressure chamber communicated with a nozzle orifice, the pressure generating element operable to generate pressure fluctuation in liquid contained in the pressure chamber to eject a liquid droplet from the nozzle orifice, when a drive signal is supplied thereto; and
- an identifier, provided with ID information including a deviation of an ejected liquid amount from a designed value when a drive signal at a first, regular drive frequency is supplied.

Preferably, the ID information includes a deviation of an ejected liquid amount from the designed value when a drive signal at a second drive frequency, which is N-times (N is an integer not less than 2) of the first drive frequency, but is not higher than an operable maximum frequency, is supplied.

According to the invention, there is also provided a liquid jetting head, comprising:

- a pressure generating element, associated with a pressure chamber communicated with a nozzle orifice, the pressure generating element operable to generate pressure fluctuation in liquid contained in the pressure chamber to eject a liquid droplet from the nozzle orifice, when a drive signal is supplied thereto; and
- an identifier, provided with ID information including a deviation of an ejected liquid amount from a designed value when a drive signal at a drive frequency which is 1/N-times (N is an integer not less than 2) of a regular drive frequency is supplied.

According to the invention, there is also provided a liquid jetting head, comprising:

a pressure generating element, associated with a pressure chamber communicated with a nozzle orifice, the pressure generating element operable to generate pressure fluctuation in liquid contained in the pressure chamber to eject a liquid droplet from the nozzle orifice, when a drive signal is supplied thereto; and an identifier, provided with ID information including a first deviation of an ejected liquid amount from a designed value when a drive signal at a first drive frequency which is N-times (N is an integer not less than 1) of a regular drive frequency is supplied, and a second deviation of an ejected liquid amount from a designed value when a drive signal at a second drive frequency which is 1/N-times (N is an integer not less than 2) of the regular drive frequency is supplied. Here, it is preferable that the first drive frequency is a half of the second drive frequency.

In the above configurations, it is preferable that: a plurality of nozzles are arranged so as to form a plurality of nozzle arrays; and the ID information is individually provided with respect to each of the nozzle arrays.

In the above configurations, it is preferable that: the liquid jetting head is operable under a plurality of operation modes which are distinguished from each other by a minimum ejected liquid amount; and the ID information is individually provided with respect to each of the operation modes.

In the above configurations, it is preferable that: the drive signal includes a first drive pulse for ejecting a liquid droplet of a first amount and a second drive pulse for ejecting a liquid droplet of a second amount greater than the first amount, which are selectively supplied to the pressure generating element to define an actual ejected amount of liquid droplet; and the ID information is determined based on either the first drive pulse or the second drive pulse. More preferably, the ID information is determined based on the second drive pulse.

In the above configurations, the identifier is provided on an exterior face of the liquid jetting head.

In the above configurations, the liquid jetting head further comprises a storage, which stores the ID information such that the stored ID information is electrically readable.

According to the invention, there is also provided a liquid jetting apparatus incorporating the above liquid jetting head, comprising:

a drive signal generator, which generates the drive signal;

a storage, which stores the ID information; and an ejection controller, which supplies the generated drive signal to the pressure generating element, while adjusting an amount of liquid to be landed on a target per unit area, in accordance with the ID information stored in the storage.

According to the invention, there is provided a liquid jetting apparatus incorporating the above liquid jetting head, comprising:

a mode selector, which selects one of the operation modes;

a drive signal generator, which generates the drive signal in accordance with the selected operation mode;

a storage, which stores the ID information; and an ejection controller, which supplies the generated drive signal to the pressure generating element, while selecting one of the ID information stored in the storage, in accordance with the selected operation mode.

Here, it is preferable that the ejection controller adjusts an amount of liquid to be landed on a target per unit area, in accordance with the selected ID information.

With the above configurations, the amount of liquid to be ejected at a frequency range employed with a high frequency can be made uniform by controlling the ID information at the time of ejection. Therefore, variations in the amount of liquid impacted per unit area can be effectively prevented.

BRIEF DESCRIPTION OF THE DRAWINGS

In the accompanying drawings,

FIG. 9 is a view showing requirements for setting an appropriate voltage;

FIG. 10A is a view showing measurement requirements for setting a color adjustment ID;

FIGS. 10B and 10C are views showing an example of the color adjustment ID;

FIG. 11A is a view showing measurement requirements to be used for setting a frequency-depending ink amount ID;

FIG. 11B is a view showing requirements for ranking the frequency-depending ink amount ID;

FIGS. 11C and 11D show an example of the set frequency-depending ink amount ID;

FIGS. 13A and 13B are views showing a memory region set in a ROM;

FIG. 14 is a descriptive view of a first drive signal generated by a drive signal generator;

DETAILED DESCRIPTION OF THE PREFERRED EMBODIMENT

Embodiments of the invention will be described hereinbelow with reference to the drawings. The embodiment will now be described by taking, as an example, an image recording apparatus (e.g., an ink jet printer or plotter), which is one form of a liquid ejecting apparatus.

The structure of the ink jet recording head (hereinafter referred to as a "recording head") will first be described. The recording head is a kind of ejection head according to the invention. An ink droplet ranging from some picoliters to some tens of picoliters is ejected by supply of a drive pulse to a piezoelectric vibrator. Here, the drive pulse is a pulse signal supplied to the piezoelectric vibrator for the purpose of ejecting an ink droplet. The ink droplet is a kind of droplet of the invention.

Figure 1:
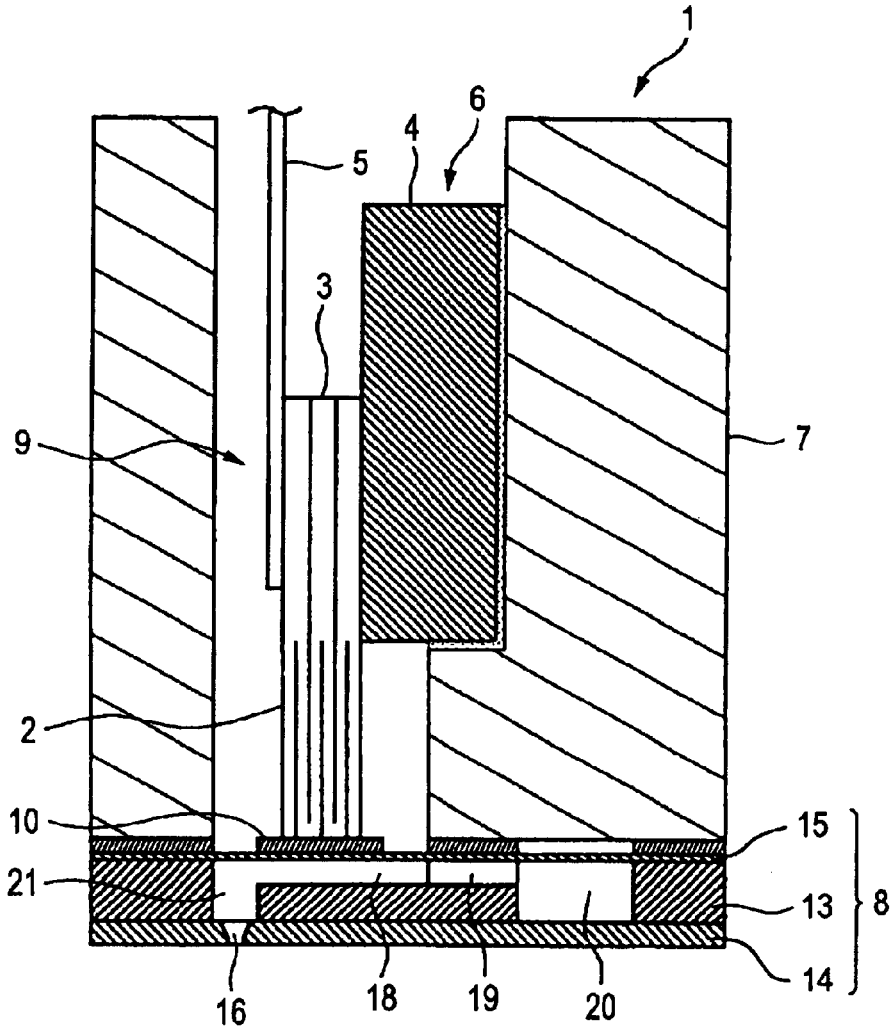
FIG. 1 is a cross-sectional view showing a portion of a recording head.

A recording head 1 illustrated in FIG. 1 has a vibrator group 3 consisting of a plurality of piezoelectric vibrators 2; a fixation plate 4; a vibrator unit 6 into which a flexible cable 5 or the like is packed as a unit; a case 7 capable of housing the vibrator unit 6; and a flow passage unit 8 to be connected to a leading-end face of the case 7.

The case 7 is a block-shaped member whose leading and trailing ends are opened, which has a container chamber 9 defined therein, and which is made of synthetic resin. The vibrator unit 6 is fixedly housed in the container chamber 9. Specifically, the vibrator unit 6 is fixed by bonding the fixation plate 4 to a wall surface of the container chamber 9 with an adhesive. In the bonded state, distal end faces of the piezoelectric vibrators 2 oppose an opening of the container chamber 9, which opening faces the flow passage unit 8.

The piezoelectric vibrators 2 constituting the vibrator group 3 are a kind of pressure generating element of the invention and also a kind of electromechanical vibrator. Each of the piezoelectric vibrators 2 of the embodiment is pectinated so as to have an extremely narrow width of about 30 $\mu$m to 100 $\mu$m. For instance, one piece of piezoelectric plate into which a piezoelectric substance layer and an internal electrode layer have been stacked one after another is bonded to the fixation plate 4. The piezoelectric substance plate is cut into a pectinated pattern by a cutting tool such as a wire saw. The vibrator group 3 is cut off from a single piezoelectric plate and formed into a unit. Hence, the expansion characteristics of the piezoelectric vibrators 2 provided in one vibrator unit 6 are made uniform with high accuracy. Proximal end portions of the respective piezoelectric vibrators 2 are bonded to the fixation plate 4. The piezoelectric vibrators 2 are attached to the fixation plate such that free-end portions of the piezoelectric vibrators 2 project outside beyond the edge of the fixation plate 4 in a cantilevered manner.

The free-end portions of the respective piezoelectric vibrators 2 expand or contract in the longitudinal direction thereof in accordance with an electric field applied to the piezoelectric substance layer. The distal end faces of the piezoelectric vibrators 2 are bonded to an island section 10 of the flow passage unit 8. When the piezoelectric vibrators 2 have expanded or contracted, the island section 10 bonded to the piezoelectric vibrators 2 is also moved. A flexible cable 5 is electrically connected to a side face of the base-end sections of the respective piezoelectric vibrators 2 (i.e., the portions of the piezoelectric vibrators bonded to the fixation plate 4), the side surface being opposite the side of the base end sections bonded to the fixation plate 4. A drive signal is supplied to the piezoelectric vibrators 2 via the flexible cable 5. The respective piezoelectric vibrators 2 can be driven within a high frequency range which is higher than that employed conventionally. For instance, a maximum drive frequency of the drive pulse has conventionally been 13 kHz. In the embodiment, the maximum drive frequency has been increased to about 34 kHz.

Figure 2:
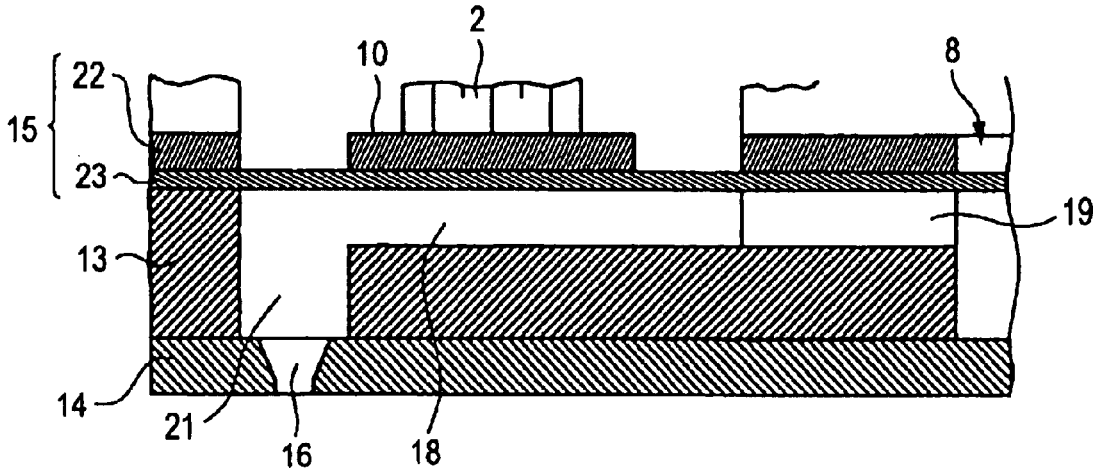
FIG. 2 is fragmentary enlarged cross-sectional view showing the structure of a flow passage unit.

As shown in FIG. 2, the flow passage unit 8 is formed by bonding a nozzle plate 14 to one surface of a flow passage formation substrate 13 and an elastic plate 15 to the other surface of the same such that the flow passage formation substrate 13 is sandwiched between the nozzle plate 14 and the elastic plate 15.

Figure 3:
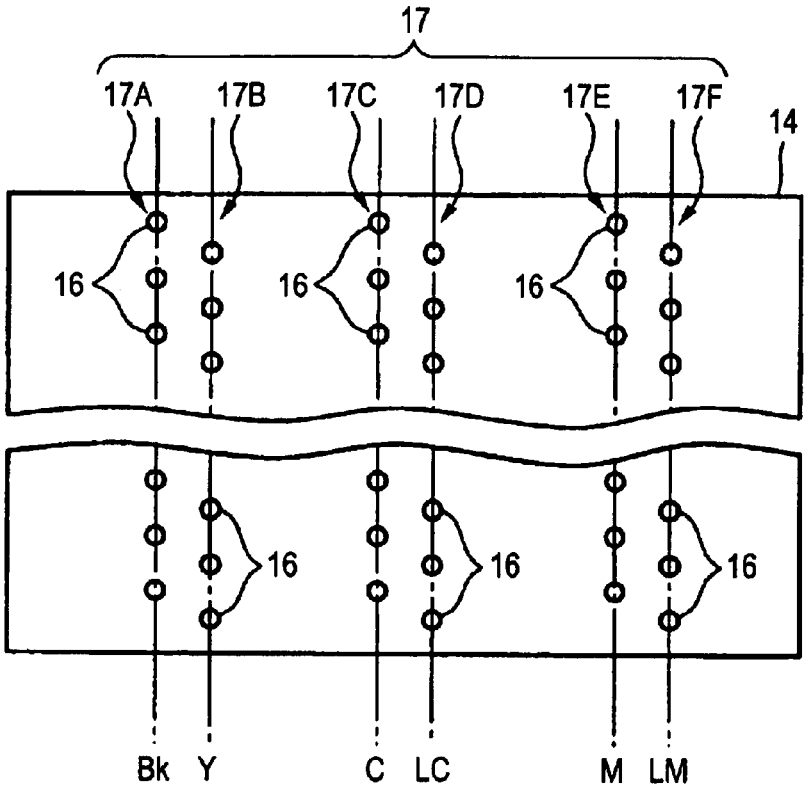
FIG. 3 is a view showing nozzle orifices and rows of nozzles.

As shown in FIG. 3, the nozzle plate 14 is a thin stainless steel plate in which a plurality of nozzle orifices 16 are opened in a row at pitches corresponding to a dot formation density. In the embodiment, 90 nozzle orifices 16 are formed at a pitch of 90 dpi, thereby constituting a nozzle row 17. A plurality of nozzle rows 17 are formed in association with the kinds of ejectable ink (e.g., colors). For instance, a total of six nozzle rows 17 are formed side by side such that a first nozzle row 17A is located at the leftmost location in the drawing and a sixth nozzle row 17F is located at the rightmost location in the same. According to the embodiment, two adjacent nozzle rows are taken as a pair. In each pair, the adjacent nozzle rows 17 are arranged such that the positions of the nozzle orifices 16 are offset from each other by one-half pitch. A first nozzle row is formed from a first nozzle row 17A and a second nozzle row 17B; a second nozzle row is formed from a third nozzle row 17C and a fourth nozzle row 17D; and a third nozzle row is formed from a fifth nozzle row 17E and a sixth nozzle row 17F.

Figure 4:
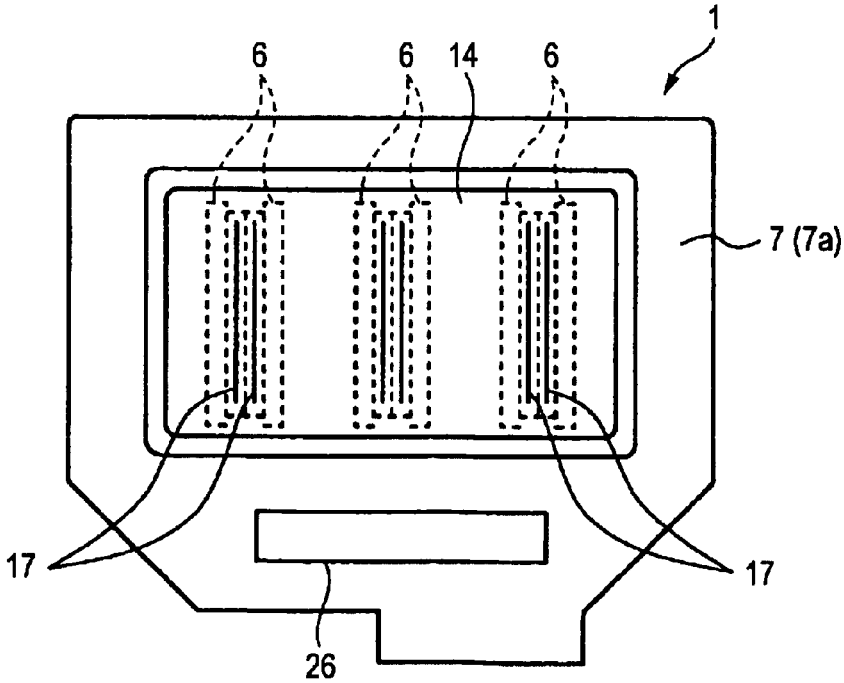
FIG. 4 is a view of the recording head when viewed from a nozzle plate.

In the embodiment, the nozzle rows 17 are arranged so as to be able to eject different colors of ink For instance, the first nozzle row 17A is arranged so as to be able to eject black ink, and the second nozzle row 17B is arranged so as to be able to eject yellow ink. Further, the third nozzle row 17C is arranged so as to be able to eject cyan ink, and the fourth nozzle row 17D is arranged so as to be able to eject light cyan ink. The fifth nozzle row 17E is arranged so as to be able to eject magenta ink, and the sixth nozzle row 17F is arranged so as to be able to eject light magenta ink. The vibrator unit 6 is provided for each nozzle row 17. As shown in FIG. 4, the recording head 1 has six vibrator units 6. The number of nozzle rows 17 and the number of vibrator units 6 are not limited to six. For instance, the number of nozzle units 17 and the vibrator units 6 may be five or less, or seven or more.

The flow passage substrate 13 is a plate member having voids which are to serve as pressure chambers 18 associated with the nozzle orifices 16 of the nozzle plate 14, groove sections which are to serve as ink supply ports 19, and a void which is to serve as a reservoir (i.e., a common ink chamber) 20. The flow passage substrate 13 is formed by, e.g., etching a silicon wafer or pressing a metal plate. The pressure chamber 18 is constructed into a recessed chamber which is narrow and flat in the direction orthogonal to the direction in which the nozzle orifices 16 are arranged (i.e., the direction of the nozzle row). The pressure chamber 18 is in mutual communication with the reservoir 20 by way of the ink supply port 19, which is narrower than the pressure chamber 18 in terms of width of a flow passage. Further, the end of the pressure chamber 18, which is opposite to the end thereof facing the ink supply port 19, is in communication with the nozzle orifice 16 by way of the nozzle communication port 21. Ink flow passages extending from the reservoir 20 to the nozzle orifices 16 by way of the pressure chamber 18 are formed in the recording head 1 in number equal to the nozzle orifices 16.

The elastic plate 15 is provided with a diaphragm section for sealing one opening surface of the pressure chamber 18, and a compliance section for sealing one opening surface of the reservoir 20. The elastic plate 15 has a two-stage structure and is constructed by laminating a stainless steel support plate 22 with a resin film 23 such as polyphenylsulfide (PPS) or polyimide (PI). A part of the support plate 22 which is to serve as the diaphragm section; that is, a part of the support plate 22 which seals the opening of the pressure chamber 18, is etched annularly, thereby forming the island section 10 to be used for bonding the distal end face of the piezoelectric vibrator 2. Further, a part of the support plate 22 which is to serve as the compliance section; that is, a part of the support plate 22 which is to seal the opening surface of the reservoir 20, is eliminated by etching, thereby leaving only the resin film 23.

In the recording head 1 having such a configuration, when the piezoelectric vibrator 2 is caused to perform electrical discharge and extend in the longitudinal direction of the vibrator, the island section 10 is pressed toward the nozzle plate 14. As a result, the resin film 23 located in the diaphragm section becomes deformed, thereby contracting the pressure chamber 18. In contrast, when the piezoelectric vibrator 2 is charged and contracted in the longitudinal direction thereof, the pressure chamber 18 expands by elasticity of the resin film 23. By controlling the expansion and contraction of the pressure chamber 18, the pressure of the ink stored in the pressure chamber 18 can be caused to fluctuate, thereby ejecting an ink droplet from the nozzle orifice 16.

In relation to the recording head 1, depending on the dimensional and assembly accuracy of components, variations arise in a characteristic pertaining to ejection of an ink droplet (e.g., ink droplet amount, which will be hereinafter called an "ink amount"). More specifically, even when an ink droplet is ejected under the same conditions, the characteristic pertaining to ejection of an ink droplet changes from one recording head 1 to another. The characteristic pertaining to ejection of an ink droplet tends to vary on a per-nozzle-row basis.

Figure 5A:
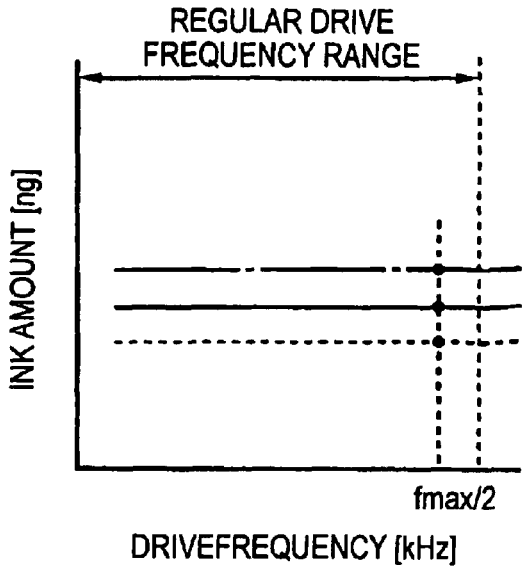
FIGS. 5A and 5B are views showing a relationship between the drive frequency of a drive pulse and the ejected ink amount.

For example, as shown in FIG. 5A, in relation to the amount of ink droplet ejected, there arise a nozzle row 17 which ejects a standard ink amount as indicated by a solid line; that is, a designed ink amount, a nozzle row 17 which ejects ink in volume less than the standard volume as indicated by dashed lines, and a nozzle row 17 which ejects ink in volume greater than the standard volume as indicated by a chain line. A difference between the ink amount ejected and the standard volume changes from one nozzle row 17 to another.

This is considered to be attributable primarily to an individual difference between the vibrator units 6 or a difference in mounted state between the vibrator units 6. For instance, when a difference exits between the vibrator units 6 in terms of the thicknesses of piezoelectric substance layers and the internal electrode layers, both layers constituting the piezoelectric plate, a difference arises in force which develops when the vibrator units 6 expand or contract (e.g., pressing force or pulling force) even when the same drive pulse is supplied to the vibrator units 6. This difference is considered to appear as a difference in the characteristic pertaining to ejection of an ink droplet. When the lengths of the free-end portions vary from one unit to another, the extent to which the free-end portions expand or contract also change. In this case, a difference in the extent to which the free-end portions expand or contract cause a difference in the range of change in the volume of the pressure chamber 18. This difference is considered to be responsible for a difference in the characteristic pertaining to ejection of an ink droplet. Further, when a change arises in bonded state between the distal end face of the piezoelectric vibrator 2 and the island section 10, a difference arises in efficiency of transmission of force developing in the piezoelectric vibrator 2. In this case, even when the piezoelectric vibrators 2 achieve the same speed or amount of expansion and contraction, a difference arises in the pressure developing in the ink stored in the ink chambers 18. The difference in ink pressure is considered to be responsible for a difference in the characteristic pertaining to ejection of an ink droplet.

Figure 5B:
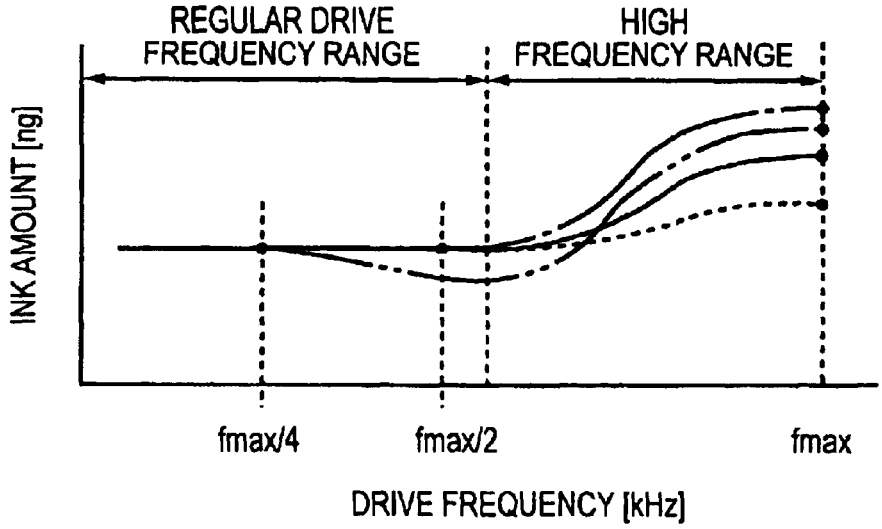

The ink amount ejected in a high frequency range changes dependent on a drive frequency of the drive pulse. For instance, as shown in FIG. 5A, a very small change arises in the range of change in the ink amount ejected within the regular drive frequency range which is frequently used at the time of actual recording operation, regardless of the drive frequency. The change remains within the admissible allowance (e.g., ±10%). However, the ink amount ejected increases with an increase in the drive frequency within the high frequency range that is higher than the regular drive frequency range. Further, the range of increase in the ink amount in the high frequency range varies from one nozzle row 17 to another. For example, as shown in FIG. 5B, even when the nozzle rows 17 eject equal volumes of ink in the regular drive frequency range, an evident difference arises in the range of increase in the ink amount within the high frequency range as indicated by the solid line, the dashed lines, and the chain line.

The difference is considered to be attributable to the state of a meniscus obtained at the time of ejection of an ink droplet. Specifically, as a result of a time interval between operations for supplying a drive pulse having been made narrower than the conventionally-employed time interval, the next ink droplet is ejected before vibration of a meniscus, which has been caused by ejection of a preceding ink droplet, sufficiently disappears. The ink amount is considered to increase under the influence of such ejection of ink If no countermeasures are taken against such an ejection characteristic, the ink amount to be impacted per unit area varies in accordance with a drive frequency (e.g., pixel density) of the drive pulse, thereby resulting in occurrence of a problem of impairment of image quality. Particularly, when an ink droplet of a very nominal volume; that is, an ink droplet of approximately 2.0 pL, is ejected, noticeable variations arise in the ink amount.

A conceivable measure for diminishing variations in the ejection characteristic is an improvement in the dimensional and assembly accuracy of components. Individual sections of the recording head 1 assume very minute shapes, and hence countermeasures for improving the dimensional and assembly accuracy are not realistic.

For this reason, in the embodiment, the drive pulse is supplied at a regular drive frequency; that is, a high frequency which is selected from the regular frequency range and used most frequently, thereby acquiring the ink amount for each nozzle row. From the thus-acquired ink amount, a color adjustment ID indicating a relative ink amount (a deviation in the ink amount ejected) for each nozzle row is obtained. Variations in ink amount between the nozzle rows are corrected through use of the color adjustment ID. Further, the drive pulse is supplied at the highest drive frequency, and hence the ink amount for each nozzle row is acquired, thereby acquiring a frequency-depending ink amount ID indicating the relative ink amount for each nozzle row on the basis of the thus-acquired ink amount. As a result of the frequency-depending ink amount ID being used at the time of recording operation, the ink amount to be impacted in the high frequency range higher than the regular drive frequency is made equal to that required in the regular drive frequency range.

Here, the term "regular drive frequency" means a frequency which is selected from a drive frequency range regularly and most frequently used at the time of use of the recording head. The regular drive frequency range varies according to the type of recording head, but variations in the ink amount due to variations in frequency remain within allowance. Specifically, the ink amount is measured for each drive frequency through use of a single drive pulse. In the regular drive frequency range, the measured ink amount remains constant within the tolerance. The term "highest drive frequency" signifies the maximum drive frequency which can be used for ejecting an ink droplet.

In the embodiment, as will be described later, the regular drive frequency is set to one-half the highest drive frequency. In other words, provided that the highest drive frequency is represented as fmax, the regular drive frequency can be represented as ½ fmax. Accordingly, the highest drive frequency can be said to be set to a value which is double the regular drive frequency.

Figure 6:
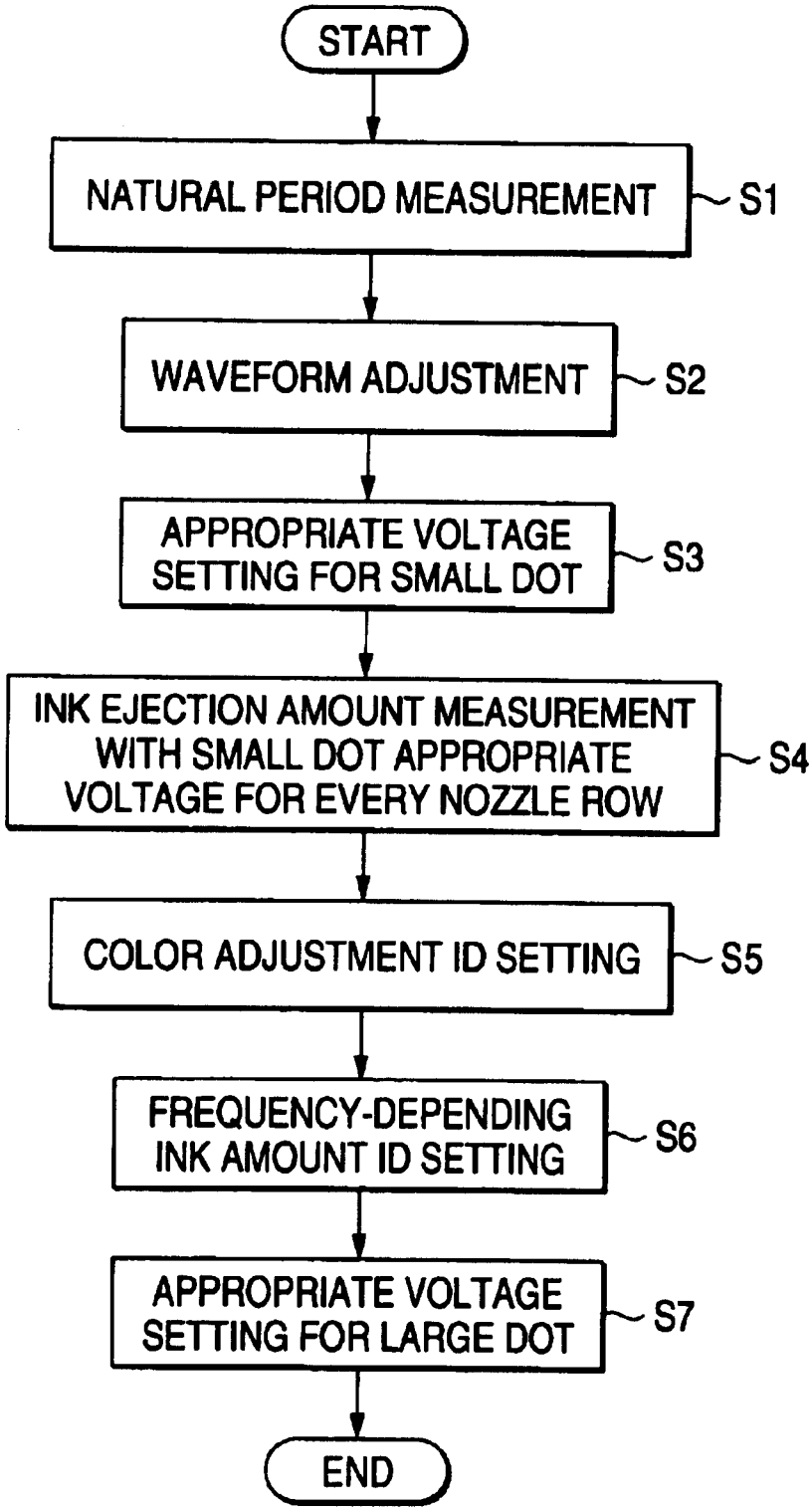
FIG. 6 is a flowchart showing procedures for inspecting a characteristic of a recording head.

The color adjustment ID and the frequency-depending ink amount ID will now be described. First, a method for imparting the respective IDs will be described. IDs are assigned at the time of inspection of characteristics of an assembled recording head 1. Therefore, the method is described along with procedures for inspecting characteristics shown in FIG. 6.

In relation to the assembled recording head 1, the natural period of ink stored in the pressure chamber 18 is measured (step S1). Here, measurement of a natural period is for making the waveform pattern of a drive pulse to be used for acquiring the color adjustment ID and the frequency-depending ink amount ID equal to the waveform pattern of the drive pulse to be used at the time of printing operation. More specifically, in relation to the drive pulse to be used at the time of printing operation, a time during which waveform elements are to be supplied and a potential difference are optimized in accordance with the natural period. The reason for this is that requirements for ejecting an ink droplet vary in accordance with the natural period.

More specifically, as a result of the ink stored in the pressure chamber 18 being compressed or decompressed, pressure vibrations which behave as if the inside of the pressure chamber 18 were a sounding tube (hereinafter called a "natural vibration of ink") arise in ink. The natural vibration affects the characteristic pertaining to ejection of an ink droplet. For instance, as a drop in the pressure of the ink stored in the pressure chamber 18 per unit time becomes greater, the compressing force exerted by the piezoelectric vibrator 2 is absorbed. As a result, the ink amount becomes smaller than that achieved when the pressure of ink has been compressed in the steady state. On the contrary, as a rise in the pressure per unit time becomes larger, the compressing force exerted by the piezoelectric vibrator 2 can be efficiently used for ejecting an ink droplet. In this case, the ink amount becomes greater than that achieved when the ink is compressed in a steady state. Accordingly, a timing at which the ink stored in the pressure chamber 18 is to be compressed or decompressed and the extent to which the ink is to be compressed or decompressed become important factors for ejecting an ink droplet under optimal requirements. A time during which waveform elements are to be supplied and a potential difference must be set in accordance with the natural period of the ink. The waveform pattern of the drive pulse to be employed at the time of use of the recording head is changed in accordance with the natural period of the ink. Hence, the drive pulse to be used for acquiring the color adjustment ID and the frequency-depending ink amount ID must be changed in accordance with the natural period. Therefore, in step S1 the natural period of the ink stored in the pressure chamber 18 is measured.

Figure 7A:
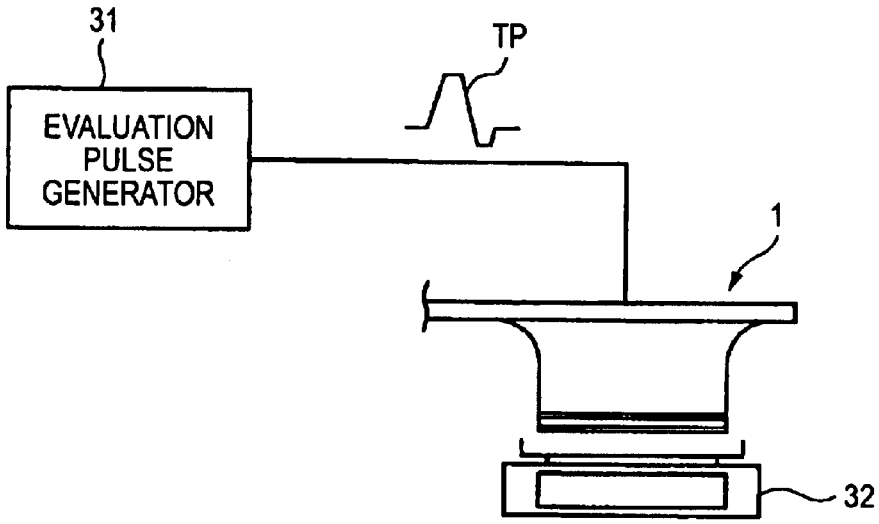
FIG. 7A is a view showing a measurement device for measuring a natural period of ink.
Figure 7B:
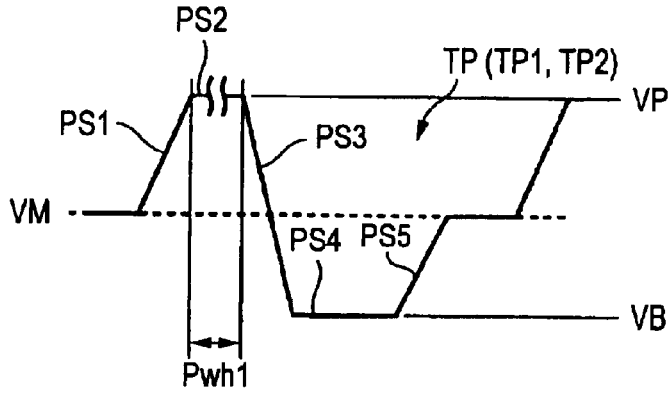
FIG. 7B is a view showing an evaluation pulse for use with the measurement device.

In the embodiment, the natural period is measured, on the basis of the volume of the ink droplet ejected as a result of an evaluation pulse TP shown in FIG. 7B, which is supplied to the piezoelectric vibrator 2. The evaluation pulse TP is formed from an excitation element PS1 which increases an electric potential from an intermediate potential VM serving as a reference potential to the highest potential VP at a given gradient; a first hold element PS2 which is generated in succession to the excitation element PS1 and maintains the highest potential VP; an ejection element PS3 which is generated in succession to the first hold element PS2 and lowers the electric potential from the highest potential VP to the minimum potential VB at a given steep gradient; a second hold element PS4 which is generated in succession to the ejection element PS3 and maintains the minimum potential VB; and a damping element PS5 which increases the electric potential from the minimum potential VB to the intermediate potential VM at a given gradient.

The excitation element PS1 induces pressure vibrations in the ink stored in the pressure chamber 18. When the excitation element PS1 is supplied to the piezoelectric vibrator 2, the piezoelectric vibrator 2 contracts from the steady state corresponding to the intermediate potential VM to a contracted state corresponding to the highest potential VP. The pressure chamber 18 expands from the standard volume to the maximum volume. As a result of expansion of the pressure chamber 18, the ink stored in the pressure chamber 18 is decompressed. The first hold element PS2 is an element for maintaining the expanded state of the pressure chamber 18. During a period over which the first hold element PS2 is supplied, the piezoelectric vibrator 2 remains contracted, whereby the pressure chamber 18 sustains the maximum volume. Over the period during which the maximum volume is maintained, pressure fluctuations keep arising in the ink stored in the pressure chamber 18. The ejection element PS3 is for ejecting an ink droplet from the nozzle orifice 16. When the ejection element PS3 is supplied to the piezoelectric vibrator 2, the piezoelectric vibrator 2 expands from the contracted state to an expanded state corresponding to the minimum potential VB. The pressure chamber 18 rapidly contracts from the maximum volume to the minimum volume. As a result, the ink stored in the pressure chamber 18 is rapidly compressed, whereupon an ink droplet is ejected from the nozzle orifice 16. The second hold element PS4 maintains the contracted state of the pressure chamber 18. While the second hold element PS4 is supplied, the piezoelectric vibrator 2 remains expanded, and the pressure chamber 18 sustains the minimum volume. The damping element PS5 is for actively damping variations in the pressure of the ink after an ink droplet has been ejected. When the damping element PS5 is supplied to the piezoelectric element 2, the piezoelectric element 2 contracts from the expanded state to the stationary state. The pressure chamber 18 expands from the minimum volume and returns to the steady-state volume.

In the embodiment, the natural period of the recording head 1 is measured by use of two types of evaluation pulses TP which differ from each other in terms of a time Pwh1 during which the first hold element PS2 is supplied; i.e., a time interval between the excitation element PS1 and the ejection element PS3. The ratio of the ink amount corresponding to one evaluation pulse TP to the ink amount corresponding to the other evaluation pulse TP (hereinafter called an "ink amount ratio") is determined. The thus-acquired ink amount ratio is applied to a correlation between the ink amount ratio and the natural period, thereby determining the natural period. This is because a one-to-one correspondence exists between the ink amount ratio and the natural period of the recording head 1. Explanations of this point will now be given.

When the evaluation pulse TP is used, the excitation element PS1 and the first hold element PS2 are successively supplied to the piezoelectric vibrator 2. As indicated by the solid line shown in FIG. 7C, periodic variations arise in the pressure of the ink stored in the pressure chamber 18. In other words, the pressure of ink varies at the foregoing natural period. In this case, the ink amount droplet to be ejected is determined by the state of the pressure of the ink stored in the pressure chamber 18 at a time point at which the ejection element PS3 is supplied (i.e., the state of the meniscus). For instance, when the ejection element P3 is supplied during the course of lowering of the ink pressure, the compressing force of the piezoelectric vibrator 2 is absorbed by variations in the pressure of the ink, and the ink amount droplet becomes smaller than a design value. On the contrary, when the ejection element PS3 is supplied during the course of a rise in the pressure of the ink, variations in the pressure of the ink are applied to the compressing force exerted by the piezoelectric vibrator 2, whereby the ink amount droplet ejected becomes greater than the design value.

Figure 7C:
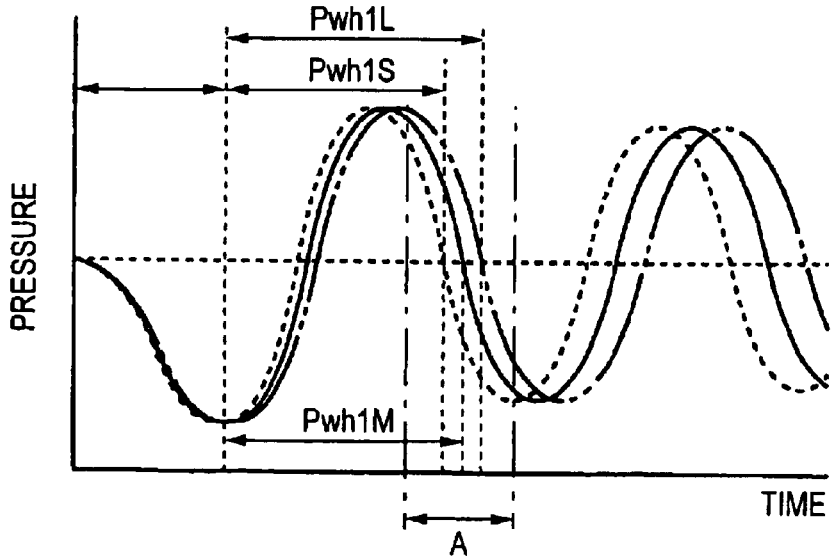
FIG. 7C is a view showing fluctuations in the pressure of ink stemming from supply of an excitation element.

For instance, in relation to the recording head 1 having a natural period indicated by a solid line shown in FIG. 7C. if the time during which the first hold element PS2 is supplied is set to Pwh1M, the ink amount ejected becomes a minimum value within the range of time indicated by A in the drawing. When the duration is set to Pwh1S, which is shorter than Pwh1M, or to PWh1L, which is longer than Pwh1M, the ink amount ejected becomes greater than the volume corresponding to Pwh1M.

In the following description, for the convenience of explanation, an evaluation pulse TP used for setting the time during which the first hold element PS2 is supplied to Pwh1S is taken as a first evaluation pulse TP1. An evaluation pulse TP used for setting the duration to Pwh1L is taken as a second evaluation pulse TP2.

If different recording heads 1 have the same natural period, the recording heads 1 eject the same ink amount by making the time during which the first hold element PS2 is supplied equal. More specifically, the recording heads 1 become equal to each other in connection with the ink amount IwS corresponding to the first evaluation pulse TP1 as well as in terms of the ink amount IwL corresponding to the second evaluation pulse TP2. If the recording heads 1, which differ from each other, have the same natural period, the ink amount ratios (IwS/IwL) assume the same value. If the recording heads 1 differ from each other in terms of natural period, the recording heads 1 eject ink in different quantities even when the first hold elements PS2 of the recording heads 1 are made equal to each other in terms of time range. For instance, as indicated by the dashed line shown in FIG. 7C, in the case of a recording head whose natural period is shorter than that of the recording head indicated by a solid line (i.e., in the case of a recording head indicated by the dashed line), a drop in ink pressure achieved at a time point when the ejection element PS3 is to be supplied differs from that achieved by the recording head indicated by the solid line. The ink quantities IwS, IwL achieved by the recording head indicated by the dashed line differ from the ink quantities IwS, IwL achieved by the recording head indicated by the solid line. Similarly, as indicated by a dashed chain line shown in FIG. 7C, even in the case of a recording head whose natural period is longer than that of the recording head indicated by the solid line, a drop in the ink pressure achieved at a time point when the ejection element PS3 is to be supplied differs from that achieved by the recording head indicated by the solid line. Hence, the ink quantities IwS and IwL achieved by the recording head indicated by the dashed chain line differ from those achieved by the recording head indicated by the solid line. Therefore, because of a difference in natural period, the recording heads 1 differ from each other in terms of an ink amount ratio (IwS/IwL).

Figure 8:
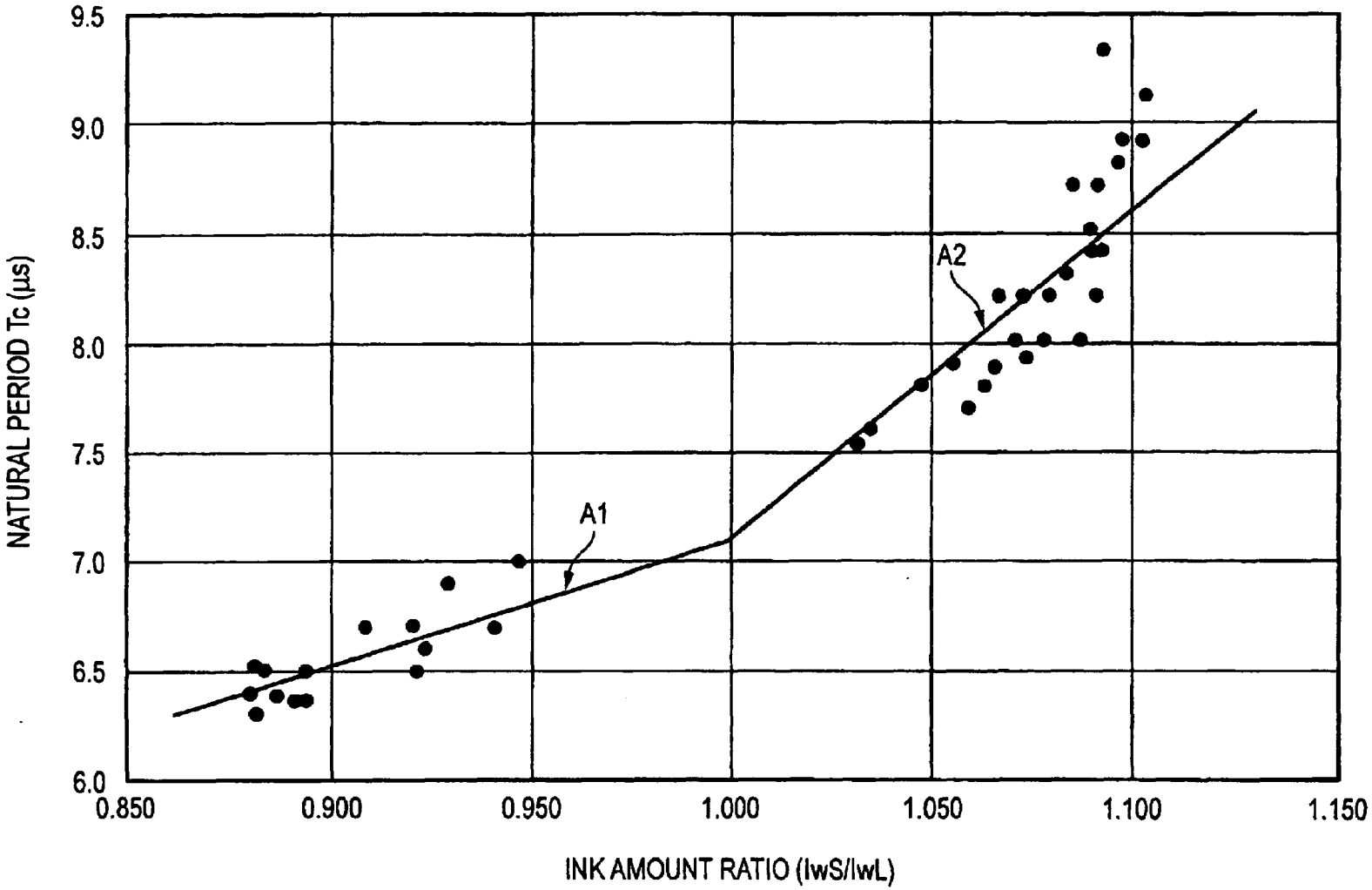
FIG. 8 is a view showing a ratio of the natural period to the ejected ink amount with respect to a plurality of recording heads.

A plurality of recording heads 1 whose natural periods are known but differ from each other are prepared as samples. By use of the sample recording heads 1, the ink amount IwS corresponding to the first evaluation pulse TP1 and the ink amount IwL corresponding to the second evaluation pulse TP2 are measured, whereby the correlation between the ink amount ratio and the natural periods can be ascertained. For example, as shown in FIG. 8, the natural period of the recording head 1 can be expressed as a set of linear expressions which employ the ink amount ratio as a variable (i.e., a set of linear expressions defined by lines A1, A2).

In the embodiment, the device shown in FIG. 7A is used for measuring the natural period of the assembled recording head 1. Specifically, the ink quantities IwS, IwL are measured through use of an evaluation pulse generator 31 and an electronic balance 32, which are capable of generating evaluation pulses TP. The evaluation pulse generator 31 and the recording head 1 are electrically connected together. The evaluation pulses TP (i.e., the first evaluation pulse TP1 and the second evaluation pulse TP2) generated by the evaluation pulse generator 31 are supplied to the piezoelectric vibrator 2, thereby causing the nozzle orifice 16 of the recording head 1 to eject an ink droplet. The weight of the thus-ejected ink droplet is measured through use of the electronic balance 32. In this case, the ink droplet ejected from the nozzle orifice 16 assumes a very small volume; that is, one ink droplet assuming a volume of some tens of picoliters (pL). Therefore, the weight of one ink droplet is some tens nanograms (ng) approximately, and hence accurate measurement of ink on a per-droplet basis is difficult. When the weight of the ink droplet is measured through use of the electronic balance 32, a plurality of ink droplets are ejected from the respective nozzle orifices 16, and the total weight of the thus-ejected ink droplets is measured. For instance, ink droplets are ejected from all the nozzle orifices 16 such that a total number of ejecting operations assumes 100,000, and the total weight of the ink droplets is measured. The thus-measured total weight is divided by the total number of ejecting operations, thereby determining the weight of one ink droplet (i.e., the ink amount).

Since only the requirement is to determine the amount of one ink droplet, the ejected ink droplets may be collected, and the total volume of the ink droplets may be measured.

In this way, if the first ink volume IwS corresponding to the first evaluation pulse TP1 and the second ink volume IwL corresponding to the second evaluation pulse TP2 have been measured, the ink amount ratio (IwS/IwL) will be calculated through arithmetic operation. The natural period of the recording head 1 is acquired from the thus-calculated ink amount ratio. For instance, the thus calculated ink amount ratio is substituted in the linear expressions A1, A2, thereby determining the natural period.

If the natural period has been measured, the waveform pattern of the drive signal to be used for the recording head 1 is adjusted on the basis of the thus-measured natural period (step S2). In the adjustment process, the waveform pattern of the drive signal is set to a pattern to be employed at the time of printing operation. Specifically, drive signal generating data to be used for producing drive signals COM1 to COM3 are generated by a drive signal generation device (not shown). The drive signal generation device is used at the time of inspection of a characteristic and has a function equivalent to that of a drive signal generator 48 provided with the recording apparatus (see FIG. 12). In relation to the first drive signal COM1 shown in FIG. 14, in the adjustment process there are set a period Pwh2 during which the damping hold element P4 to be used for defining a timing, at which supply of a damping element is to be initiated, is generated, constant potential element time ranges Pdis1 to Pdis3 to be used for defining a time interval between adjacent drive pulses, and an intermediate potential Vm serving as a reference potential. In relation to the second drive signal COM2 shown in FIG. 15, a time Pwd$\mu$2 during which the contraction damping element 18 is to be generated are set. Further, in relation to the third drive signal COM3 shown in FIG. 16, a time period Pwd$\mu$4 during which a first construction damping element P29 is to be generated is set.

If the waveform pattern appropriate for a natural period; that is, if the drive signal generating data has been generated, a voltage appropriate for a small-dot drive pulse is set (step S3). In this example, a voltage VH2S appropriate for a first small-dot drive pulse DP5 included in the second drive signal COM2 and a voltage VH3S appropriate for a second small-dot drive pulse DP7 are set. Setting of these appropriate voltages involve use of the drive signal generation device and the electronic scale. First, the appropriate voltage VH3S for the second small-dot drive pulse DP7 included in the third drive signal COM3 is set. Second, the appropriate voltage VH2S for the first small-dot drive pulse DP5 is set. The drive frequency of the piezoelectric vibrator 2 employed at the time of setting of the appropriate voltage; that is, the drive frequency of the drive pulse, is a regular drive frequency commonly used at the time of use of the recording head 1 (i.e., when the recording apparatus performs printing operation). In the embodiment, the regular drive frequency is set to one-half (the median) of the maximum drive frequency which can be supplied to the piezoelectric vibrator 2. The reason for this is that the drive frequency is most stable from the viewpoint of performance. Since the maximum drive frequency (fmax) of the piezoelectric vibrator 2 of the illustrated recording head 1 is 34 kHz, the drive frequency obtained at the time of setting of an appropriate voltage is set to 17 kHz, as shown in FIG. 9. The appropriate voltage is determined by, e.g., trial and error. The second small-dot drive pulse PD7 will now be described. A drive voltage of the second small-dot drive pulse PD7 (i.e., a potential difference between a third maximum potential Vh3 and the minimum potential VL) is set temporarily. The second small-dot drive pulse DP7 given the temporary drive voltage is supplied to all the piezoelectric vibrators 2 at a drive frequency of 17 kHz, thereby ejecting ink droplets. The ink droplets are captured, and the weight of one ink droplet is calculated from the weight of the thus-captured ink droplets. In short, a mean weight of one ink droplet is calculated.

Once the ink amount has been calculated, the thus-calculated ink amount and a design value (1.6 ng or 1.6 pL) are compared with each other, and a new temporary drive voltage corresponding to the difference is set. Specifically, a potential difference between the waveform elements is changed in proportion to the temporary drive voltage while the time range of each of the waveform elements (P24 to P31) is held intact.

Once the new temporary drive voltage has been set, the second small-dot drive pulse DP of the temporary voltage is supplied to all the piezoelectric vibrators 2 at a drive frequency of 17 kHz, thereby measuring the volume of one ink droplet. Subsequently, the foregoing operations have been performed repeatedly. The temporary voltage at which the design value has been achieved is taken as the appropriate voltage VH3S. Here, the appropriate voltage HV3S also varies depending on the temperature of a measurement environment. Therefore, when the temperature of the measurement environment for the temporary drive voltage has deviated from 25° C., the appropriate voltage VH3S is set to a voltage for 25° C. by multiplying the temporary drive by a temporary compensation coefficient.

If the appropriate voltage VH3S of the second small-dot drive pulse DP7 has been determined, the appropriate voltage VH2S for the first small-dot drive pulse DP5 is then determined. Determination of the appropriate voltage VH2S for the first small-dot drive pulse DP5 is also performed in accordance with the same procedures as those by which the appropriate voltage VH3S has been determined. Specifically, the first small-dot drive pulse DP5 set at the temporary drive voltage is supplied to all the piezoelectric vibrators 2 at a frequency of 17 kHz, thereby measuring the ink amount. The temporary drive voltage at which the target value (2.5 pL) has been achieved is determined as the appropriate voltage VH2S.

Once the appropriate voltages VH2S, VH3S for the small-dot drive pulses DP5, DP7 have been determined, the ink amount is measured for each nozzle row 17 in order to determine a color adjustment ID (step S4). The drive signal generation device and the electronic balance have been used also for measuring the ink amount under the conditions shown in FIG. 10A. More specifically, the first small-dot drive pulse DP5 adjusted to the appropriate voltage VH2S is supplied to the respective piezoelectric vibrators 2 (i.e., the piezoelectric vibrators 2 belonging to the nozzle row 17 which is an object of measurement) at a frequency of 17 kHz (fmax/2). Once the ink amount has been measured for one nozzle row 17, the ink amount is measured for another nozzle row 17.

Once the ink amount has been measured for all the nozzle rows 17, the color adjustment ID is determined (step S5). The color adjustment ID is set on the basis of the ink amount for each nozzle row, thereby showing a deviation from the ink amount which serves as the target value. In the embodiment, a case where a deviation from the target value is 0% is taken as [50] points. As the deviation increments toward the positive range by 1%, the [50] points increment by one point. In contrast, when the deviation decrements toward the negative range by 1%, the [50] points decrement by one point.

For instance, provided that the target ink amount is 2.5 pL and that the ink amount of the nozzle row 17 for which a color adjustment ID is to be set is also 2.5 pL, there is no deviation from the target ink amount, and hence the deviation assumes 0%. In this case, the color adjustment ID to be assigned to the nozzle row 17 assumes [50] points. Further, provided that the ink amount of the nozzle row 17 for which the color adjustment ID is to be set is 2.4 pL, a deviation from the target ink amount is 0.1 pL. Hence, the ink amount of the nozzle row 17 deviates from the target ink amount toward the negative range by 4%. In this case, the color adjustment ID assigned to the nozzle row 17 assumes [46] points, which is lower than [50] points by four points. Similarly, when the ink amount of the nozzle row 17 for which a color adjustment ID is to be set assumes 2.3 pL, the ink amount deviates from the target ink amount by 0.2 pL (−8%). Hence, the color adjustment ID assumes [42] points.

The same also applies to a case where the ink amount droplet is greater than the target volume. More specifically, the ink amount of the nozzle row 17 for which a color adjustment ID is to be set assumes 2.6 pL, the ink amount deviates from the target volume by 0.1 pL (+4%). Hence, the color adjustment ID assumes [54] points. In the case where the ink amount assumes 2.7 pL, the ink amount deviates from the target ink amount by 0.2 pL (+8%). Hence, the color adjustment ID assumes [58] points.

In the case of the recording head 1 shown in FIG. 10B, the first nozzle row 17A and the fourth nozzle row 17D assume a color adjustment ID of [46], showing that the ink amount ejected from these nozzle rows is 2.4 pL. The second nozzle row 17B and the fifth nozzle row 17E assume a color adjustment ID of [50], showing that the ink amount ejected from these nozzle rows is 2.5 pL. The third nozzle row 17C and the sixth nozzle row 17F assume a color adjustment ID of [54], showing that the ink amount ejected from these nozzle rows is 2.6 pL. In the case of a recording head 1 shown in FIG. 10C, the first nozzle row 17A and the sixth nozzle row 17F assume a color adjustment ID of [46] (the ink amount=2.4 pL), and the second nozzle row 17B assumes a color adjustment ID of [42] (the ink amount=2.3 pL). The third nozzle row 17C and the fifth nozzle row 17E assume a color adjustment ID of [50] (the ink amount=2.5 pL), and the fourth nozzle row 17D assumes a color adjustment ID of [58] (the ink amount=2.7 pL). In the embodiment, the color adjustment ID is represented as a deviation showing an offset from the mean ink amount. However, the invention is not limited to such a configuration. For instance, the ink amount for each nozzle row may be used, in unmodified form, as a color adjustment ID. In short, various information items can be used, so long as the information enables identification of the ink amount for each nozzle row at a regular drive frequency.

If the color adjustment IDs have been set in this way, frequency-depending ink amount IDs will now be set (step S6). As mentioned above, the frequency-depending ink amount ID shows a relative ink amount (i.e., a deviation in ink amount) between nozzle rows within the maximum drive frequency range which can be supplied to the piezoelectric vibrator 2. The frequency-depending ink amount ID is also set on the basis of the ink amount determined for each nozzle row. As shown in FIG. 11B, according to the embodiment, four ranks are set in accordance with the ink amount. For instance, as shown in FIG. 11A, the first small-dot drive pulse DP5 of appropriate voltage is supplied to the piezoelectric vibrator 2 at a frequency of 34 kHz, and the ink amount is measured for each nozzle row. The thus-measured ink amount is divided by a design value of 2.5 ng (pL). On the basis of the resultant divided value (Iw/2.5), the ink amount is classified into one of four ranks. Specifically, if the divided value pertaining to the nozzle row 17 is 1.50 or more, a value of [0] is set as a frequency-depending ink amount ID (IwF). If the divided value ranges from 1.25 to 1.50, a value of [1] is set as the frequency-depending ink amount ID. If the divided value ranges from 1.00 to 1.25, a value of [2] is set as the frequency-depending ink amount ID. If the divided value is 1.00 or less, a value of [3] is set as a frequency-depending ink amount ID.

In the case of the recording head 1 described in FIG. 11C, the third nozzle row 17C and the fourth nozzle row 17D assume a frequency-depending ink amount ID of [1]. Within the maximum drive frequency range, there are ejected ink droplets which are about 1.25 to 1.5 times the design value (the ink amount achieved in the regular drive frequency range); that is, 3.1 to 3.8 ng (pL) approximately. Other nozzle rows 17 assume a frequency-depending ink amount ID of [2]. Within the maximum drive frequency range, there are ejected ink droplets which are about 1.00 to 1.25 times the design value (2.5 to 3.1 ng). In the case of the recording head 1 described in FIG. 11D, the first nozzle row 17A and the second nozzle row 17B assume a frequency-depending ink amount ID of [3] (1.00 times or less the design value). The third nozzle row 17C assumes a frequency-depending ink amount ID of [1] (1.25 times to 1.5 times the design value). The fourth nozzle row 17D to the sixth nozzle row 17F assume a frequency-depending ink amount ID of [2] (1.00 times to 1.25 times the design value).

In the embodiment, the frequency-depending ink amount ID is expressed by rank information to be classified in accordance with the ink amount. However, the invention is not limited to such a configuration. For instance, the ink amount for each nozzle row may be used intact as an ID. When a rate of increase in the ink amount with respect to an increase in drive frequency is approximated by a linear expression, a gradient of the linear expression may be used as an ID. Namely, the ink amount Iw achieved at that drive frequency is approximated by the following expression (1), the gradient [a] may be used as an ID.

$$Iw=[a]\times\text{drive frequency}+\text{mean ink amount at regular frequency} \quad (1)$$

In short, if the ink amount achieved at the maximum drive frequency is information which is recognizable on a per-nozzle-row basis, various information items can be used as a frequency-depending ink amount ID.

Once the frequency-depending ink amount ID has been determined, the appropriate voltage of the large-dot drive pulse is set (step S7). In this example, the voltage VH1 appropriate for the normal-dot drive pulses DP1 to DP3 included in the first drive signal COM1 is set. The setting is also performed in the same manner as that in which the appropriate voltage of the small-dot drive pulse is set. For instance, the required drive pulses DP1 to DP3 are supplied at a frequency of 17 kHz (regular drive frequency), and a drive voltage is adjusted such that the ink amount ejected becomes equal to the target value.

Figure 12:
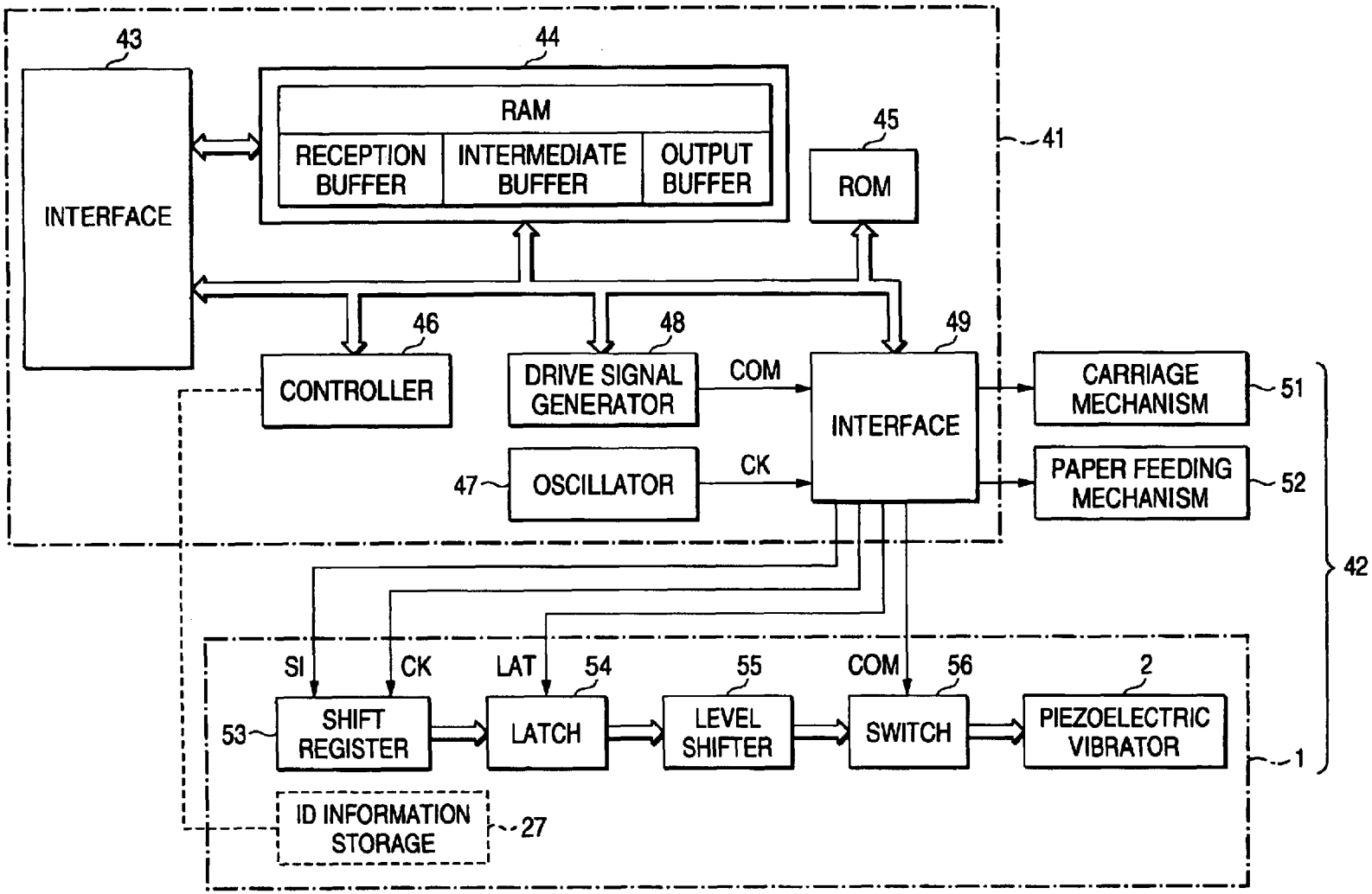
FIG. 12 is a block diagram showing the configuration of a recording apparatus.

A round of operations is completed by setting an appropriate voltage of the large-dot drive pulse. Information about a natural period measured through the foregoing processes, information about the appropriate voltages of the respective drive pulses, and information about the color adjustment IDs and the frequency-depending ink amount IDs are assigned to the recording head 1 by way of an information imparting medium and provided for controlling operation to be performed by the recording apparatus. Information items are described on the surface of an indication member 26 such as an adhesive seal, and the indication member is affixed to the surface of the recording head 1. In the embodiment, as shown in FIG. 4, the indication member 26 is affixed to the surface of a flange section 7*b* of a case 7. The information items provided on the surface of the indication member 26 are utilized for a controller 46 of the recording apparatus (see FIG. 12). The information items are used for setting a waveform pattern of a drive signal and controlling the ink amount droplet to be impacted per unit area. For instance, the information items are stored in a predetermined region of a ROM 45 provided on the printer controller 41 through use of information input means such as a keyboard, whereby the controller 46 can utilize the information items. As shown in FIG. 12, the information items are stored in an ID information storage 27 of the recording head 1 (e.g., corresponding to one type of information assigning medium, such as EEPROM or flash RAM) in an electrically readable manner.

The ID information storage 27 and the controller 46 may be electrically connected together. Even in such a case, the information items are provided to the recording head 1 by way of an information assigning medium.

A method for using the information about a natural period, the information about an appropriate voltage, the information about color adjustment IDs, and the information about the frequency-depending ink amount ID will now be described. FIG. 12 is a block diagram showing an electrical configuration of an ink jet recording apparatus (hereinafter referred to as a "recording apparatus"), such as a printer or a plotter.

The illustrated recording apparatus has a printer controller 41 and a print engine 42. The printer controller 41 has an interface 43 for receiving print data or the like output from a host calculator (not shown) or the like; a RAM 44 for storing various types of data; the ROM 45 for storing control routines or the like for effecting various data processing operations; the controller 46 formed from a CPU or the like; an oscillator 47 for generating a clock signal; a drive signal generator 48 for generating drive signals COM1 to COM3 to be supplied to a recording head 1; and an interface 49 for transmitting record data and a drive signal, which have been obtained by converting the print data on a per-dot basis. The print engine 42 is formed from the recording head 1, a carriage mechanism 51, and a paper feeding mechanism 52. The recording head 1 comprises a shift register 53 into which the record data are set; a latch 54 for latching the record data set in the shift register 53; a level shifter 55 which is to serve as a voltage amplifier; a switcher 56 for controlling supply of a drive signal to piezoelectric vibrators 2; and the piezoelectric vibrators 2.

The controller 46 operates in accordance with an operation program stored in the ROM 45, thereby controlling individual sections of the recording apparatus. For example, the controller 46 outputs drive signal generating data to the drive signal generator 48, thereby generating drive signals COM1 to COM3 (see FIGS. 14 to 16) of waveform patterns determined by the generating data and controlling supply of the drive pulses (DP1 to DP7) included in the drive signals COM1 to COM3 to the piezoelectric vibrators 2.

As shown in FIG. 13A, portions of the ROM 45 are used as a natural period information storage region 45*a* storing information about natural periods; an appropriate voltage information storage region 45*b* storing information about appropriate voltages; a color adjustment ID storage region 45*c*, and a frequency-depending ink amount ID storage region 45*d*. In other words, the ROM 45 also serves as a kind of ID information storage of the invention. The controller 46 refers to the ROM 45 at the time of generation of the drive signal, generates drive signal generating data on the basis of information about natural periods and information about appropriate voltages, and generates drive signals COM1 to COM3 of waveform patterns optimum for use with the recording head 1 mounted on the recording apparatus.

Now, a drive signal to be generated by the drive signal generator 48 will be described. In the embodiment, three types of drive signals COM1 to COM3 associated with recording modes are prepared in the manner mentioned previously. The recording modes are defined in accordance with the ink amount of the minimum ink droplet. In the embodiment, the recording modes are classified into three types of modes: that is, a high-speed recording mode, a first high-resolution recording mode, and a second high-resolution recording mode. The high-speed recording mode is a recording mode using the first drive signal COM1 shown in FIG. 14. The minimum ink amount in this mode is 13 pL (13 ng). The first high-resolution recording mode is a recording mode using the second drive signal COM2 shown in FIG. 15. The minimum ink amount in this mode is 2.5 pL. The second high-resolution recording mode is a recording mode using the second drive signal COM3 shown in FIG. 16. The minimum ink amount in this mode is 1.6 pL. The high-speed recording mode is suitable for printing documents and graphs; the first high-resolution recording mode is suitable for recording digital images; and the second high-resolution recording mode is suitable for recording digital images with ultra-high image quality.

The first drive signal COM1 shown in FIG. 14 is formed by connection in succession of the plurality of drive pulses DP1 to DP3 having the same waveform pattern. The first drive signal COM1 comprises the first drive pulse DP1 to be generated at the beginning of one print cycle T; the second drive signal pulse DP2 generated in succession to the first drive pulse DP1; and the third drive signal pulse DP3 generated in succession to the second drive pulse DP2. The first drive signal COM1 is generated repeatedly, once in each print cycle T. The drive pulses DP1 to DP3 are normal-dot drive pulses which solely enable ejection of an ink droplet of 13.3 pL. Each of the drive pulses DP1 to DP3 comprises an expansion element P1 which increases an electric potential from an intermediate potential Vm serving as an intermediate potential to the first highest potential Vh1 at such a given gradient that no ink droplets are ejected; an expansion hold element P2 which maintains the first highest potential Vh1 for a predetermined time period; an ejection element P3 which lowers the electric potential from the first highest potential Vh1 to the lowest potential VL at a steep gradient; a damping hold element P4 which maintains the lowest potential VL for a predetermined time period; and a damping element P5 which increases the electric potential from the lowest potential VL to the intermediate potential Vm.

When such drive pulses DP1 to DP3 are supplied to the piezoelectric vibrator 2, an ink droplet of 13.3 pL is ejected from the nozzle orifices 16 every time each of the drive pulses is supplied to the recording apparatus. More specifically, when supplied with the expansion element P1, the pressure chamber 18 expands from a steady-state volume corresponding to the intermediate potential Vm to a maximum volume corresponding to the first highest potential Vh1. The expanded state of the pressure chamber 18 is maintained over a time period during which the expansion hold element P2 is supplied. Subsequently, the ejection element P3 is supplied to the pressure chamber 18, and the pressure chamber 18 rapidly contracts from the maximum volume to the minimum volume corresponding to the lowest potential VL. As a result of rapid contraction of the pressure chamber 18, the ink stored in the pressure chamber 18 is compressed, whereupon an ink droplet is ejected from the nozzle orifice 16. Subsequently, the pressure chamber 18 is held in an contracted state over a time period during which the damping hold element P4 is supplied. When supplied with the damping element P5, the pressure chamber 18 expands and returns to the steady-state volume. As a result of expansion and returning of the pressure chamber 18, fluctuations in the pressure of the ink stored in the pressure chamber 18 are efficiently dampened.

In this case, the controller 46 changes the time Pwh2, during which the damping hold element P4 is to be generated, and the intermediate potential Vm in accordance with the natural period of the recording head 1; that is, information about the natural period, thereby optimizing the waveform patterns DP1 to DP3 of the respective drive pulses and intervals Pdis1 to Pdis3 between the adjacent drive pulses. Further, the drive voltage (i.e., a potential difference between the first highest potential Vh1 and the lowest potential VL) is set to an appropriate voltage VH1 through use of information about an appropriate voltage. In this case, the appropriate voltage VH1 is corrected to a voltage value suitable for an environment temperature on the basis of environment temperature information output from an unillustrated thermistor.

Figure 15:
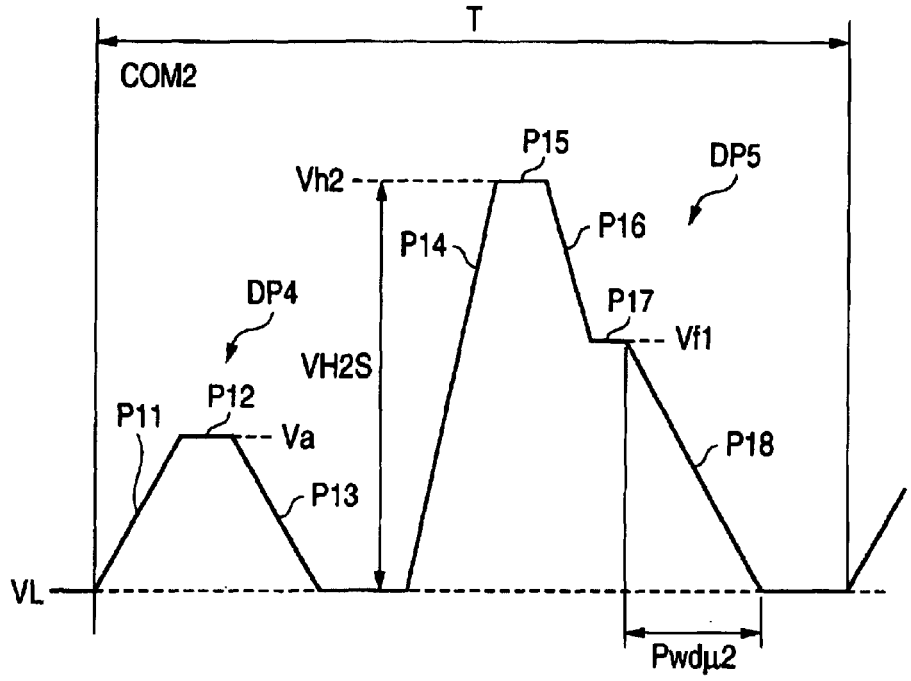
FIG. 15 is a descriptive view of a second drive signal generated by the drive signal generator.

The drive signal COM2 shown in FIG. 15 includes a vibrating pulse DP4 for minutely vibrating a meniscus, and a first small-dot drive pulse DP5 which is formed in succession to the vibrating pulse DP4 and causes the nozzle orifices 16 to eject small-dot ink droplets. The drive signal COM2 is generated repeatedly in every print cycle T.

Here, the vibrating pulse DP4 is a drive pulse for minutely vibrating the meniscus and comprises a vibrating expansion element P11, a vibrating hold element P12 for maintaining a vibrating potential Va, and a vibrating contraction element P13 for lowering the electric potential from the vibrating potential Va to the lowest potential VL at a relatively gentle gradient. When the vibrating pulse DP4 is supplied to the piezoelectric vibrator 2, the meniscus is minutely vibrated in the vicinity of the nozzle orifices 16, thereby preventing in an increase in viscosity of ink. The pressure chamber 18 slightly expands in response to the vibrating expansion element P11, whereupon the meniscus is slightly drawn toward the pressure chamber 18. Over a time period during which the vibrating hold element P12 is supplied, the meniscus is subjected to free vibration. In response to the vibrating contraction element P13, the pressure chamber 18 expands slightly, whereby the meniscus is pushed slightly toward the ejection side.

The first small-dot drive pulse DP5 is a pulse signal to be used for ejecting an ink droplet of small volume of 2.5 pL approximately. The first small-dot drive pulse DP5 comprises a pulling element P14 for increasing the electric potential from the minimum potential VL to a second highest potential Vh2 at a relatively steep gradient; a pull-in hold element P15 which maintains the second highest potential Vh2 for an extremely short time period; an ejection element P16 for lowering the electric potential from the second highest potential Vh2 to an ejection potential Vf1, which is slightly lower than the second highest potential Vh2, at a relatively steep gradient; an ejection hold element P17 for maintaining the ejection potential Vf1 for a very short time period; and a contraction damping element P18 for lowering the electric potential from the ejection potential Vf1 to the lowest potential VL at a relatively gentle gradient. The controller 46 (waveform determinant) controls the drive signal generator 48 in accordance with information about natural periods and information about appropriate voltages, thereby changing a time Pwd$\mu$2 during which the contraction damping element P18 is to be generated.

When the first small-dot drive pulse DP5 is supplied to the piezoelectric vibrator 2, the piezoelectric vibrator 2 and the pressure chamber 18 operate in the following manner, whereby ink droplets of small volume are ejected from the nozzle orifice 16. Specifically, in association with supply of the pulling element P14, the piezoelectric vibrator 2 greatly contracts, whereupon the pressure chamber 18 quickly expands from the minimum volume to the maximum volume. In association with expanding action, the pressure chamber 18 is greatly decompressed. As a result, the meniscus is greatly pulled toward the pressure chamber 18. At this time, the center of the meniscus; that is, the center and neighborhood of the nozzle orifice 16, is temporarily pulled greatly. Subsequently, the pull-in hold element P15 is supplied, whereby the meniscus remains swelled in the form of a pillar in reaction to the pulling action. Next, the ejection element P16 is supplied to the pressure chamber 18, whereby the ink stored in the pressure chamber 18 is slightly compressed, and the pillar portion of the meniscus is ejected as an ink droplet. In association with ejection of the ink droplet, the meniscus is greatly vibrated. However, by the contraction damping element P18, the pressure chamber 18 gently contracts, thereby damping vibration of the meniscus which would arise after ejection of an ink droplet.

Figure 16:
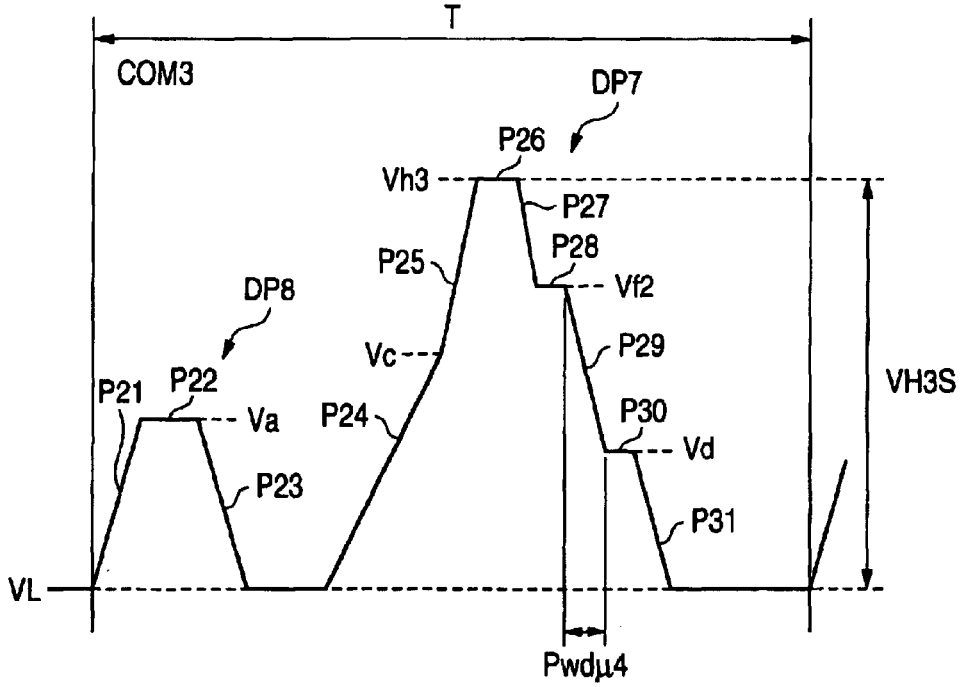
FIG. 16 is a descriptive view of a third drive signal generated by the drive signal generator.

The drive signal COM3 shown in FIG. 16 comprises a vibrating pulse DP6 for minutely vibrating a meniscus, and a second small-dot drive pulse DP7 which is generated in succession to the vibrating pulse DP6 and causes the nozzle orifices 16 to eject small-dot ink droplets.

Like the vibrating pulse DP4 of the second drive signal COM2, the vibrating pulse DP6 is a drive pulse for effecting the meniscus vibration during the printing. The vibrating pulse DP6 comprises a vibrating expansion element P21, a vibrating hold element P22, and a vibrating contraction element P23. When the vibrating pulse DP6 is supplied to the piezoelectric vibrator 2, the meniscus is minutely vibrated in the vicinity of the nozzle orifices 16, thereby preventing occurrence of an increase in viscosity of ink. Since the minute vibrating operation is identical with that of the vibrating pulse DP4 of the second drive signal COM2, its explanation is omitted.

The second small-dot drive pulse DP7 is formed as a pulse signal in which there are connected, in this order, a pull-in preparation element P24 for causing the electric potential to rise from the lowest potential VL to a pull-in intermediate potential Vc; a pulling element P25 for causing the electric potential to rise from the pull-in intermediate potential Vc to a third highest potential Vh3 at a gradient steeper than that of the pull-in preparation element P24; a pull-in hold element P26 which maintains the third highest potential Vh3 for a very short time period; an ejection element P27 for lowering the electric potential from the third highest potential Vh3 to an ejection potential Vf2 at a steep gradient; an ejection hold element P28 for maintaining the ejection potential Vf2 for an extremely short time period; a first contraction damping element P29 for lowering the electric potential from the ejection potential Vf2 to an intermediate discharge potential Vd at a given gradient; an intermediate damping hold element P30 for maintaining the intermediate discharge potential Vd for an extremely short time period; and a second contraction damping element P31 for lowering the electric potential from the intermediate discharge potential Vd to the lowest potential VL at a given gradient. The controller 46 controls the drive signal generator 48 through use of the information about a natural period and the information about appropriate voltages. The drive voltage VH3S of the second small-dot drive pulse DP7 and a time period Pwd$\mu$4, during which the first contraction damping element P29 is to be generated, are changed.

When the second small-dot drive pulse DP7 is supplied to the piezoelectric vibrator 2, the piezoelectric vibrator 2 and the pressure chamber 18 are operated in the following manner, whereby ink droplets of 1.6 pL approximately are ejected from the nozzle orifices 16. In other words, as a result of the pull-in preparation element 24 being supplied to the piezoelectric vibrator 2, the pressure chamber 18 expands at such a speed that the meniscus is not subjected to excessive vibration. Subsequently, the pulling element P25 is supplied, thereby causing the pressure chamber 18 to rapidly expand to the maximum volume. The center portion of the meniscus is locally pulled toward the pressure chamber 18. Next, the pressure chamber 18 is held in an expanded state by supply of the pull-in hold element P26. As a reaction to expansion, the center portion of the meniscus is caused to swell toward the direction of ejection in the form of a convex shape. Subsequently, the ejection element P27 is supplied to the pressure chamber 18, whereby the pressure chamber 18 is rapidly contracted, whereupon the pillar of ink is pushed in the direction of ejection. The ejection hold element P28, the first contraction damping element P29, the intermediate damping hold element P30, and the second contraction damping element P31 are sequentially supplied to the pressure chamber 18, thereby contracting the pressure chamber 18 in a stepwise manner. As a result, the leading end of the pillar of ink is torn apart from the main body of the pillar of ink, whereby the leading end portion of the ink pillar flies in the direction of ejection, and ink droplets of very small volume of about 1.6 pL are ejected from the nozzle orifices 16.

The controller 46 controls the ink amount droplet impacted per unit area (i.e., the number of ink droplets ejected) for each nozzle row 17 on the basis of the color adjustment ID and the frequency-depending ink amount ID, thereby correcting the density of an image. Therefore, the controller 46 perceives the color adjustment ID and the frequency-depending ink amount ID, both pertaining to the recording head 1 mounted on the recording apparatus, by reference to the color adjustment ID storage region 45*c* of the ROM 45 and the frequency-depending ink amount ID storage region 45*d*, both being shown in FIG. 13A. The controller 46 acquires a correlation between the density of an image pertaining to print data and the number of ink droplets ejected per unit area (i.e., the ink amount impacted), from the perceived color adjustment ID and the perceived frequency-depending ink amount ID. The thus-acquired correction is stored in the storage means such as the RAM 44.

In the embodiment, the basic number of ejecting operations per unit area is set on the basis of the color adjustment ID. This basic number of ejecting operations is corrected on the basis of reference table information shown in FIG. 13B. The reference table information is stored in a portion of, e.g., the ROM 45 (a reference table information storage region 45*e*). The reference table information is realized by storing a limitation ratio pertaining to the ink amount to be discharged, for each of the ranks of the frequency characteristic volume ID. Here, the term "limitation ratio" defines a percentage of ejecting operations with respect to the standard number of ejecting operations in a high frequency range used while the number of ejecting operations per unit area in the regular drive frequency range (i.e., the ink amount to be discharged) is taken as a standard. In this example, the limitation ratio assigned to the frequency-depending ink amount ID[0] is set to [66%]. This means that the number of ejecting operations in the high frequency range is limited to 66% of the standard number of ejecting operations. Similarly, the limitation ratio assigned to the frequency-depending ink amount ID[1] is [73%]. This means that the number of ejecting operations in the high frequency range is limited to 73% the standard number of ejecting operations. Further, the limitation ratio assigned to the frequency-depending ink amount ID[3] is [100%]. This means that the number of ejecting operations in the high frequency range is the same as the standard number of ejecting operations (i.e., 100%).

In this way, in relation to the density of the image which is used with high frequency, the number of ejecting operations is corrected on the basis of the color adjustment ID. In relation to the high frequency range where variations tend to arise in the amount of ink, the number of ejecting operations is corrected on the basis of the frequency-depending ink amount ID. Hence, even when ink droplets are ejected in the regular frequency range or the high frequency range, an image having superior color balance can be recorded. Specifically, even when the maximum drive frequency of the drive pulse is increased, an improved quality image which involves very few variations in the amount of ink droplet impacted in each nozzle row can be recorded. As a result, shortening of a print time and an improvement in image quality can be embodied.

In the embodiment, the combination of the color adjustment ID and the frequency-depending ink amount ID is one type. However, a plurality of types of combinations may be prepared for the respective recording modes. For instance, a total of three combinations may be prepared; that is, a combination for the high-speed recording mode; a combination for the first high-resolution recording mode; and a combination for the second high-resolution recording mode. As a matter of course, the recording modes are not limited to three types. They may be embodied as four types or more or two types. Further, the frequency-depending ink amount ID may not be assigned to the recording head 1, and only the color adjustment ID may be assigned to the recording head 1. In this case, as a result of use of the color adjustment ID, the nozzle rows 17 achieve a uniform ink amount in the regular drive frequency range. Therefore, images having necessary and sufficient image quality can be recorded at the time of printing data having few areas to be recorded as solid, such as photograph data.

In the embodiment, the ink amount consumed in the high frequency range can be ascertained accurately. Hence, the controller 46 can also be caused to serve as a remaining ink amount determinant which calculates the amount of ink consumed from the number of operations for ejecting ink droplets, thereby determining the volume of usable ink. As a result, a difference between the volume of consumed ink which can be perceived through control and the ink amount actually consumed can be reduced. More specifically, the accuracy of the ink amount consumed in the high frequency range can be improved through use of the frequency-depending ink amount ID. As a result, control of a display pertaining to the volume of remaining ink can be improved when compared with the display control performed conventionally. A timing at which ink cartridges and ink packs are to be replaced can be reported accurately.

The embodiment has described a case where the color adjustment ID and the frequency-depending ink amount ID are set for each nozzle row 17. However, the invention is not limited to this embodiment. The invention is susceptible to various modifications within the scope defined by the claims.

For example, the color adjustment ID may be determined on the basis of the amount of liquid which has been obtained by supplying a drive pulse at a one-Nth (N is a natural number of 2 or more) of the regular drive frequency. The reason for this is that the amount of liquid ejected may be changed even at the regular drive frequency depending on an employed recording mode.

For instance, as indicated by the dashed chain line in FIG. 5B, there may be a case where the ink amount temporarily drops in the vicinity of the regular drive frequency (fmax/2 in FIG. 5B). In such a case, the drive pulse is supplied to the piezoelectric vibrator 2 at a frequency which is one-half (N=2, fmax/4) or one-third (N=3) the regular drive frequency, thereby measuring the ink amount. Preferably, the color adjustment ID is defined on the basis of the ink amount. This will be described by taking the embodiment as an example. Since the regular drive frequency of the embodiment is 17 kHz, the drive frequency of the drive pulse is set to, e.g., 8.5 kHz (N=2), 5.7 kHz (N=3), thereby acquiring the ink amount for each nozzle row. The color adjustment ID is obtained from a deviation existing between the thus-acquired volumes of ink pertaining to the respective nozzle rows. The color adjustment ID obtained at the drive frequency which is one-Nth of the regular drive frequency is stored in the color adjustment ID storage region 45*c* of the ROM 45. As in the case of the embodiment, the color adjustment ID is used for controlling ejection of ink droplets. As a result, even in a recording mode in which variations arise in the ink amount at the regular drive frequency, an image which involves occurrence of few variations in the ink amount droplet impacted for each nozzle row 17 and has superior image quality can be recorded.

As mentioned above, in relation to the recording apparatus of this time, a recording apparatus capable of effecting recording operation in a plurality of recording modes is in vogue. Therefore, a plurality of color adjustment IDs may be prepared for respective recording modes and stored in the color adjustment ID storage region 45*c*. In accordance with the recording mode, a color adjustment ID to be used may be switched. Further, the degree of change in the ink amount at the regular drive frequency may change according to the kind of liquid to be ejected or the temperature of a use environment. Therefore, a plurality of types of color adjustment IDs may be prepared for service conditions; that is, recording modes, the kinds of ink, and the temperature of a use environment, and stored in the color adjustment ID storage region 45*c*. A color adjustment ID to be used may be switched according to the service condition.

For instance, a first color adjustment ID obtained at the regular drive frequency (N=1, fmax/2) and a second color adjustment ID obtained at one-half the regular drive frequency (N=2, fmax/4) are assigned to the recording head by way of an information imparting medium, such as the indication member 26 and the ID information storage 27, and stored in the color adjustment ID storage region 45*c*. Once the color adjustment IDs have been acquired, the color adjustment IDs are assigned to the recording head 1 via the information assigning media 26, 27. As mentioned above, the color adjustment ID is referred to by the controller 46 at the time of actual recording operation, and the number of times ink droplets are ejected is controlled on the basis of the color adjustment ID.

In this case, the controller 46 selects either the first or second color adjustment ID according to the service condition. On the basis of the thus-selected color adjustment ID, the controller 46 adjusts the number of times ink droplets are ejected, thereby controlling the ink amount droplet impacted per unit area. In any of the recording modes, an image which involves occurrence of few variations in the ink amount droplet impacted for each nozzle row 17 and has superior image quality can be recorded. Further, as a result of the conditions, such as a working temperature and the kind of ink, being taken into consideration, an image with high quality can be obtained. In this case, the controller 46 selects a recording mode to be used from among the plurality of recording modes (kinds of ejection modes). Further, the drive signal generator produces a drive signal corresponding to the recording mode selected by the controller 46 (e.g., any one of the drive signals COM1 to COM3).

The embodiment has described the case where the color adjustment ID and the frequency-depending ink amount ID are set as liquid amount ID information and where the IDs are set for the respective nozzle rows 17. The liquid amount ID information may be set for each recording head 1. For instance, a deviation from the designed ink amount (reference value) may be measured for each recording head 1, and a head ink amount ID showing the deviation may be assigned to the recording head 1 by way of the information assigning mediums 26, 27.

As in the case of the embodiment, one type or a plurality of types of the head ink amount IDs are set according to the drive frequency of the drive pulse at the time of acquisition of an ID. For example, a first head ink amount ID obtained by supplying a drive pulse at the regular drive frequency, a second head ink amount ID obtained by supplying the drive pulse at one-half the regular drive frequency, and a head ink volume obtained when the drive pulse is supplied at the maximum drive frequency can be set as the head ink amount IDs.

Figures 17A, 17B:
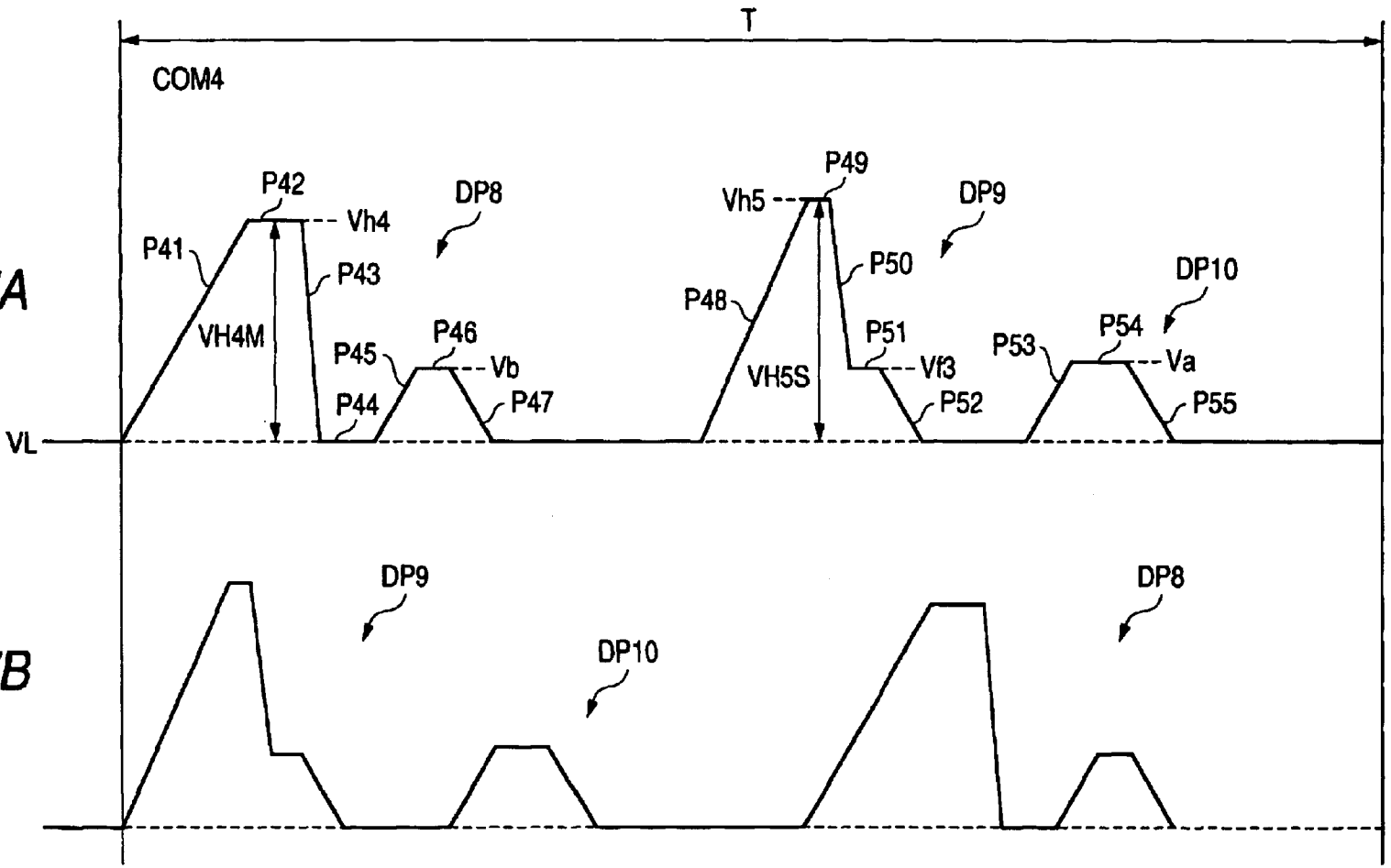
FIGS. 17A and 17B are descriptive views of a fourth drive signal generated by the drive signal generator.

Further, the liquid volume identification information may be set for each drive pulse to be used for ejecting ink droplets. FIG. 17 is a view showing the embodiment, describing a drive signal COM4 generated by the drive signal generator 48. The drive signal COM4 comprises a middle-dot drive pulse DP8 for ejecting ink droplets of 6 pL approximately; a small-dot drive pulse DP9 for ejecting an ink droplet of 2 pL; and a vibrating pulse DP10 for minutely vibrating a meniscus of ink. The drive signal COM4 is generated repeatedly in each print cycle T. The drive signal COM4 is formed from a forward drive signal which is shown in FIG. 17A and to be generated when the recording head 1 is moved forward; and a backward drive signal which is shown in FIG. 17B and to be generated when the recording head 1 is moved backward. The drive signals are common to each other in terms of comprising the respective drive pulses DP8 to DP10. The drive signals differ from each other in terms of sequence in which the drive pulses DP8 to DP10 are to be generated (i.e., arrangement of the drive pulses in the print cycle T). More specifically, in the case of the forward drive signal, the middle-dot drive pulse DPB, the small-dot drive pulse DP9, and the vibrating pulse DP10 are arranged in this order from the beginning of the print cycle T. Further, in the case of the backward drive signal, the small-dot drive pulse DP9, the small-dot drive pulse DP9, and the drive pulse DP8 are arranged in this order in the print cycle T.

The middle-dot drive pulse DP 8 has an ejection pulse section (P41 to P43) to be used for ejecting ink droplets, a damping pulse section (P45 to P47) which are generated in succession to the ejection pulse and which dampens vibration of the meniscus which would arise after ejection of ink droplets, and a pulse connection element P44 for connecting the ejection pulse section to the damping pulse section. The ejection pulse section comprises an expansion element P41 for causing the electric potential to increase from the minimum potential VL to a fourth highest potential Vh4 at such a gradient that no ink droplets are ejected; an expansion hold element P42 which is generated in succession to the expansion element P41 and maintains the fourth highest potential Vh4 for a predetermined time period; and an ejection element P43 for lowering the electric potential from the fourth highest potential Vh4 to the minimum potential VL at a relatively steep gradient. The damping pulse section comprises a damping expansion element P45 for causing the electric potential to rise from the minimum potential VL to the damping potential Vb at such a relatively gentle potential gradient that no ink droplets are ejected; a damping hold element P46 which is generated in succession to the damping expansion element P45 and maintains the damping potential Vb for a predetermined time period; and a damping contraction element P47 which is generated in succession to the damping hold element P46 and lowers the electric potential from the damping potential Vb to the minimum potential VL at a relatively gentle gradient. The pulse connection element P44 connects the trailing edge of the ejection element P3 to the leading edge of the damping expansion element P4 at the minimum potential VL.

When the middle-dot drive pulse DP8 is supplied to the piezoelectric vibrator 2, the piezoelectric vibrator 2 and the pressure chamber 8 operate in the following manner, thereby ejecting ink droplets in the neighborhood of 6 pL from the nozzle orifice 16. In association with supply of the expansion element P41, the piezoelectric vibrator 35 contracts greatly, and the pressure chamber 18 expands greatly from the minimum volume, whereupon the meniscus is greatly drawn toward the pressure chamber 18. The expanded state of the pressure chamber 18 is held over the time period during which the expansion hold element P42 is supplied. At a timing at which the thus-drawn meniscus has returned to the vicinity of the edge of the nozzle orifice 16, the ejection element 43 is supplied. The pressure of the ink stored in the pressure chamber 18 rapidly increases, whereby the center portion of the meniscus extends in the form of a pillar. The pulse connection element P44 and the damping expansion element P45 are supplied in succession to the ejection element P43, whereby the pressure chamber 18 is expanded again, thereby decompressing the ink stored in the pressure chamber 18. Further, after lapse of the time defined by the damping hold element P46, the damping contraction element P47 is supplied, thereby contracting the pressure chamber 18. As a result of these elements P45 to P47, the vibrations of the meniscus are immediately dampened.

The small-dot drive pulse DP9 comprises an expansion element P48 for causing the electric potential to increase from the minimum potential VL to a fifth highest potential Vh5 at a relatively steep gradient; an expansion hold element P49 which is generated in succession to the expansion element P48 and maintains the fifth highest potential Vh5 for a very short time period; an ejection element P50 for lowering the electric potential from the fifth highest potential Vh5 to a third ejection potential Vf3 at a steep gradient; an ejection hold element P51 for maintaining the third ejection potential Vf3 for a very short time period; and a damping element P52 for lowering the electric potential from the third ejection potential Vf3 to the minimum potential VL at a relatively gentle gradient.

When the small-dot drive pulse DP9 is supplied to the piezoelectric vibrator 2, the piezoelectric vibrator 2 and the pressure chamber 18 operate as follows. An ink droplet of 2 pL is ejected from the nozzle orifice 16. In association with supply of the expansion element P48, the piezoelectric vibrator 2 contracts greatly, and the pressure chamber 18 expands immediately from the minimum volume to the maximum volume. In association with expanding action, the pressure chamber 18 is greatly decompressed, whereupon the meniscus is greatly drawn toward the pressure chamber 18 from the steady state. At that time, the center of the meniscus; that is, the center of the nozzle orifice 16, is temporarily withdrawn greatly. Subsequently, the center of the meniscus is raised in a convex form in reaction to the drawing action. Next, the ejection element 50 is supplied to the pressure chamber 18, whereby the pressure chamber 18 rapidly contracts, thereby compressing ink. The center of the meniscus immediately grows in the form of a pillar of ink. Subsequently, the leading end portion of the thus-grown pillar of ink is torn apart. As a result, a small ink droplet whose amount corresponds to the small dot is ejected.

Like the vibrating pulses DP4, DP6, the vibrating pulse DP10 is a drive pulse to be used for effecting the meniscus vibration during the printing. The vibrating pulse DP10 is formed from a vibrating expansion element P53, a vibrating hold element P54, and a vibrating contraction element P55. When the vibrating pulse DP10 is supplied to the piezoelectric vibrator 2, the meniscus is minutely vibrated in the vicinity of the nozzle orifice 16, thereby preventing an increase in the viscosity of ink. Here, the minute vibrating action is identical with that described in connection with the vibrating pulses DP4, DP6, and hence its explanation is omitted.

In the case of the drive signal COM4, recording can be performed with four gradation levels by selectively supplying the drive pulse to the piezoelectric vibrator 2. Specifically, recording can be performed in a gradation 0 (non-recording operation) in which the vibrating pulse DP10 is supplied to the piezoelectric vibrator 2 and no ink droplet is ejected; a gradation 1 (small dot recording) in which the small-dot pulse DP9 is supplied to the piezoelectric vibrator 2, thereby ejecting a small ink droplet from the nozzle orifice 16; a gradation 2 (middle dot recording) in which the middle-dot drive pulse DP8 is supplied to the piezoelectric vibrator 2, to thereby eject a middle ink droplet from the nozzle orifice 16; and a gradation 3 (large dot recording) in which the middle-dot drive pulse DP8 and the small-dot drive pulse DP9 are supplied to the piezoelectric vibrator 2, thereby ejecting a large ink droplet from the nozzle orifice 16.

From among the drive pulses constituting the drive signal COM4, the small-dot drive pulse DP9 is a kind of standard drive pulse of the invention. The small-dot drive pulse DP9 is a drive pulse which serves as a standard ink amount ejected (volume of liquid ejected) in relation to the drive signal COM4. A drive voltage VH5S (a potential difference between the fifth highest potential Vh5 to the minimum potential VL) is defined such that the ink amount ejected becomes equal to the specified volume (e.g., 2 pL). Further, the middle-dot drive pulse DP8 is a kind of subordinate drive pulses of the invention. Specifically, the drive voltage VH4M (i.e., an electric potential between the fourth highest potential Vh4 to the minimum potential VL) of the middle-dot drive pulse DP8 is defined in accordance with the amount of ink ejected as a result of supply of the small-dot drive pulse DP9 to the piezoelectric vibrator 2. In the embodiment, the drive voltage VH4M is defined such that the volume of a large ink droplet (i.e., a sum of the volume of the small ink droplet and the volume of the middle ink droplet) becomes equal to the specified volume (e.g., 11 pL). In this case, the ink amount ejected at the middle dot drive pulse DP8 is defined in accordance with the ink amount ejected by the small-dot drive pulse DP9. Hence, when only the middle-dot drive pulse DP8 is supplied to the piezoelectric vibrator 2, the ink amount droplet ejected from the nozzle orifice 16 varies within the range of, e.g., 5 pL to 7 pL.

Variations in the ink amount cause variations in color tone (i.e., variations in the ink amount impacted) when the middle-dot drive pulse DP8 is used alone. For this reason, the variations are not desirable. For instance, when an image recorded through use of a certain recording head 1 is compared with an image recorded through use of another cording head 1, there arises a problem of occurrence of a difference in color tone, because the middle dots of the images are different in size from each other. In order to solve the problem, according to the embodiment, a subordinate ink amount ID indicating a deviation of the ink amount ejected as a result of supply of the middle-dot drive pulse DP8 (i.e., the volume of middle ink droplets) from the standard volume is assigned to the recording head by way of the information assigning media 26, 27. The controller 46 corrects the ink amount droplet impacted per unit area, on the basis of the subordinate ink amount ID by reference to the subordinate ink amount ID at the time recording operation is performed through use of the middle ink droplets.

Even in relation to the subordinate ink amount ID, the drive frequency of the middle-dot drive pulse DP8 which is obtained at the time of acquisition of the ID presents a problem. However, the ID is selected in the same manner as mentioned in connection with the embodiment. For example, identification information based on the amount of ink obtained by supply of the drive pulse DP8 at the regular drive frequency (i.e., 17 kHz in the embodiment) and identification information based on the ink amount obtained by supply of the drive pulse DP8 at the maximum drive frequency (i.e., 37 kHz in the embodiment) may be used in combination. Alternatively, there may also be employed identification information based on the ink amount obtained as a result of supply of the drive pulse DP8 to the piezoelectric vibrator 2 at the regular drive frequency, or ID information based on the ink amount obtained as a result of supply of the drive pulse DP8 at one-half the regular drive frequency (i.e., 8.5 kHz in the embodiment).

The foregoing descriptions have explained the invention by taking the image recording apparatus which is a kind of liquid ejecting device as an example. However, the invention can also be applied to another liquid ejecting device or various pieces of manufacturing apparatus, for example, a display manufacturing apparatus, an electrode forming apparatus, and a chip manufacturing apparatus.

Although the piezoelectric vibrator 2 is illustrated as a pressure generating element in the embodiments, the pressure generating element is not limited to the piezoelectric vibrator. The pressure generating element may be embodied by an element capable of causing fluctuations in the pressure of the ink stored in the pressure chamber 18. For example, a magnetostrictive element, which is a kind of an electromechanical conversion element, or a heating element which causes boiling in the ink stored in the pressure chamber 18 may also be employed.

What is claimed is:

1. A liquid jetting head, comprising:

a pressure generating element, associated with a pressure chamber communicated with a nozzle orifice, the pressure generating element operable to generate pressure fluctuation in liquid contained in the pressure chamber to eject a liquid droplet from the nozzle orifice, when a drive signal is supplied thereto; and an identifier, provided with ID information including a deviation of an ejected liquid amount from a designed value when a drive signal at a first, regular drive frequency is supplied.

2. The liquid jetting head as set forth in claim 1, wherein the ID information includes a deviation of an ejected liquid amount from the designed value when a drive signal at a second drive frequency, which is N-times (N is an integer not less than 2) of the first drive frequency, but is not higher than an operable maximum frequency, is supplied.

3. A liquid jetting head, comprising:

a pressure generating element, associated with a pressure chamber communicated with a nozzle orifice, the pressure generating element operable to generate pressure fluctuation in liquid contained in the pressure chamber to eject a liquid droplet from the nozzle orifice, when a drive signal is supplied thereto; and an identifier, provided with ID information including a deviation of an ejected liquid amount from a designed value when a drive signal at a drive frequency which is 1/N-times (N is an integer not less than 2) of a regular drive frequency is supplied.

4. A liquid jetting head, comprising:

a pressure generating element, associated with a pressure chamber communicated with a nozzle orifice, the pressure generating element operable to generate pressure fluctuation in liquid contained in the pressure chamber to eject a liquid droplet from the nozzle orifice, when a drive signal is supplied thereto; and an identifier, provided with ID information including a first deviation of an ejected liquid amount from a designed value when a drive signal at a first drive frequency which is N-times (N is an integer not less than 1) of a regular drive frequency is supplied, and a second deviation of an ejected liquid amount from a designed value when a drive signal at a second drive frequency which is 1/N-times (N is an integer not less than 2) of the regular drive frequency is supplied.

5. A liquid jetting head, comprising:

a pressure generating element, associated with a pressure chamber communicated with a nozzle orifice, the pressure generating element operable to generate pressure fluctuation in liquid contained in the pressure chamber to eject a liquid droplet from the nozzle orifice, when a drive signal is supplied thereto; and an identifier, provided with ID information including a first deviation of an ejected liquid amount from a designed value when a drive signal at a first, regular drive frequency is supplied, and a second deviation of an ejected liquid amount from the designed value when a drive signal at a second, operable maximum drive frequency is supplied.

6. The liquid jetting head as set forth in claim 5, wherein the first drive frequency is a half of the second drive frequency.

7. The liquid jetting head as set forth in any one of claims 1, 2, 4 and 5, wherein:

a plurality of nozzles are arranged so as to form a plurality of nozzle arrays; and the ID information is individually provided with respect to each of the nozzle arrays.

8. The liquid jetting head as set forth in any one of claims 1, 2, 4 and 5, wherein:

the liquid jetting head is operable under a plurality of operation modes which are distinguished from each other by a minimum ejected liquid amount; and the ID information is individually provided with respect to each of the operation modes.

9. A liquid jetting apparatus incorporating the liquid jetting head as set forth in claim 8, comprising:

a mode selector, which selects one of the operation modes;

a drive signal generator, which generates the drive signal in accordance with the selected operation mode;

a storage, which stores the ID information; and an ejection controller, which supplies the generated drive signal to the pressure generating element, while selecting one of the ID information stored in the storage, in accordance with the selected operation mode.

10. The liquid jetting apparatus set forth in claim 9, wherein the ejection controller adjusts an amount of liquid to be landed on a target per unit area, in accordance with the selected ID information.

11. The liquid jetting head as set forth in any one of claims 1, 2, 4 and 5, wherein:

the drive signal includes a first drive pulse for ejecting a liquid droplet of a first amount and a second drive pulse for ejecting a liquid droplet of a second amount greater than the first amount, which are selectively supplied to the pressure generating element to define an actual ejected amount of liquid droplet; and the ID information is determined based on either the first drive pulse or the second drive pulse.

12. The liquid jetting head as set forth in claim 9, wherein the ID information is determined based on the second drive pulse.

13. The liquid jetting head as set forth in any one of claims 1, 2, 4 and 5, wherein the identifier is provided on an exterior face of the liquid jetting head.

14. The liquid jetting head as set forth in any one of claims 1, 2, 4 and 5, further comprising a storage, which stores the ID information such that the stored ID information is electrically readable.

15. A liquid jetting apparatus incorporating the liquid jetting head as set forth in any one of claims 1, 2, 4 and 5, comprising:

a drive signal generator, which generates the drive signal;

a storage, which stores the ID information; and an ejection controller, which supplies the generated drive signal to the pressure generating element, while adjusting an amount of liquid to be landed on a target per unit area, in accordance with the ID information stored in the storage.

* * * * *